US006606018B2

(12) United States Patent
Takano et al.

(10) Patent No.: US 6,606,018 B2
(45) Date of Patent: Aug. 12, 2003

(54) ELECTROMAGNETIC RELAY

(75) Inventors: Satoshi Takano, Tokyo (JP); Shigemitsu Aoki, Tokyo (JP)

(73) Assignee: Takamisawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/105,189

(22) Filed: Mar. 26, 2002

(65) Prior Publication Data

US 2002/0135446 A1 Sep. 26, 2002

(30) Foreign Application Priority Data

Mar. 26, 2001 (JP) ..... 2001-088421

(51) Int. Cl.[7] ..... H01H 51/22
(52) U.S. Cl. ..... 335/78; 335/83
(58) Field of Search ..... 335/78–86, 196–200, 335/202

(56) References Cited

U.S. PATENT DOCUMENTS

| | | | | | |
|---|---|---|---|---|---|
| 4,302,742 | A | | 11/1981 | Schedele | 335/202 |
| 4,310,818 | A | | 1/1982 | Essler et al. | 335/135 |
| 5,392,015 | A | * | 2/1995 | Matsuoka et al. | 335/78 |
| 5,719,541 | A | | 2/1998 | Mader | 335/78 |
| 5,864,270 | A | * | 1/1999 | Hoffman | 335/78 |

FOREIGN PATENT DOCUMENTS

| | | |
|---|---|---|
| DE | 31 47 563 A1 | 10/1982 |
| DE | 41 15 092 A1 | 11/1992 |
| DE | 200 07 905 U1 | 7/2000 |
| EP | 0 751 544 A1 | 1/1997 |
| JP | 5-15285 | 2/1993 |
| JP | 7-1554 | 1/1995 |
| JP | 2000-149749 | 5/2000 |
| JP | 2000-268693 | 9/2000 |
| JP | 2000-311569 | 11/2000 |
| JP | 2000-348590 | 12/2000 |

OTHER PUBLICATIONS

Patent Abstracts of Japan; JP 2000 149749, published May 30, 2000.

* cited by examiner

*Primary Examiner*—Roman M. Barrera
(74) *Attorney, Agent, or Firm*—Arent Fox Kintner Plotkin & Kahn, PLLC

(57) ABSTRACT

An electromagnetic relay including a base including a receptacle, an electromagnet assembly incorporated in the base, and a contact section incorporated in the base to be actuated by the electromagnet assembly. The contact section includes a fixed contact member located away from the electromagnet assembly at at least a predetermined insulating distance, and a movable contact member located opposite to the fixed contact member at a position further away from the electromagnet assembly than the fixed contact member. The fixed contact member is provided with a fixed contact portion, a first terminal portion, a fitting portion arranged between the fixed contact portion and the first terminal portion, the fitting portion being fitted and inserted in a lateral direction into the receptacle of the base, and an extending portion arranged between the fitting portion and the first terminal portion, the extending portion extending to be exposed outside from the receptacle. The movable contact member is provided with a movable contact portion capable of contacting with the fixed contact portion of the fixed contact member, and a second terminal portion spaced from the first terminal portion of the fixed contact member. The extending portion of the fixed contact member is shaped and dimensioned to ensure at least the insulating distance and to maintain a predetermined terminal pitch between the first terminal portion of the fixed contact member and the second terminal portion of the movable contact member.

25 Claims, 16 Drawing Sheets

ELECTROMAGNETIC RELAY

BACKGROUND OF THE INVENTION

1. Field of the Invention

The present invention relates generally to a relay, and more particularly to an electromagnetic relay having a structure for ensuring a sufficient insulating distance between certain parts of the relay.

2. Description of the Related Art

In a conventional electromagnetic relay including an electromagnet assembly and a contact section actuated by the electromagnet assembly to perform a make/break operation, it is known that the electromagnet assembly and the contact section are incorporated in a common base and that an insulating wall formed integrally with or separately from the base is interposed between the electromagnet assembly and the contact section so as to ensure a sufficient electrical insulation therebetween.

Japanese Unexamined Utility Model Publication (Kokai) No. 7-1554 (JP-U-7-1554) discloses an electromagnetic relay including an electromagnet assembly and a contact section, both incorporated in a common base. The electromagnet assembly has a structure wherein an armature, adapted to be driven by an electromagnet, is arranged oppositely to an axial end face of an iron core of the electromagnet in a pivotable manner, the end face extending generally orthogonal to a center axis of a coil. The contact section includes a movable contact member, adapted to be shifted due to the pivoting motion of the armature, and a pair of fixed contact members respectively disposed so as to oppositely face the both sides of the movable contact member, the movable and fixed contact members being arranged side-by-side along the coil center axis at a location away from the armature with the electromagnet placed between the contact members and the armature. The base is provided integrally with a first portion having a cylindrical wall for surrounding a part of the electromagnet assembly and a second portion having a plurality of receptive grooves for individually receiving the movable contact member and the fixed contact members in the contact section. In this structure, the cylindrical wall provided in the first portion of the base is interposed between the electromagnet assembly and the contact section so as to ensure an electrical insulation therebetween, and a separate insulator is additionally mounted adjacent to the cylindrical wall so as to enhance the insulation performance.

In this electromagnetic relay, each of the contact members in the contact section is provided with a contact portion at one longitudinal end, a terminal portion at another longitudinal end and a fitting portion between the contact and terminal ends, and the contact members are securely mounted to the second portion of the base by respectively fitting and inserting the fitting portions thereof in a lateral direction from one lateral edges of the fitting portions into the corresponding receptive grooves. In this regard, the fixed contact portions of the fixed contact members are respectively located at positions allowing the movable contact portion of the movable contact member disposed between the fixed contact members to alternately contact with the fixed contact portions in accordance with the pivoting motion of the armature. On the other hand, the terminal portions of the fixed and movable contact members project outward from the second portion of the base and are located in a line at predetermined intervals or pitches larger than the intervals of the contact portions. In this configuration, in order to ensure a predetermined insulating distance between the electromagnet assembly and the contact section as well as to maintain the predetermined terminal pitches in the contact section, the outside dimension of the electromagnetic relay tends to be increased relatively in a direction of the coil center axis, which results in a useless space around the contact portions of the contact members.

Japanese Unexamined Patent Publication (Kokai) No. 2000-268693 (JP-A-2000-268693) discloses an electromagnetic relay including an electromagnet assembly, and a contact section, which have a positional correlation similar to that of the electromagnet assembly and the contact section disclosed in JP-U-7-1554, but can effectively reduce the dimension along the coil center axis. In this electromagnetic relay, a base includes first and second portions formed as separate members and assembled together, the first portion being provided with a cylindrical wall for partially surrounding the electromagnet assembly, and the second portion being provided with a plurality of receptive grooves for individually receiving a movable contact member and a pair of fixed contact members in the contact section. When the first and second portions are properly assembled with each other, the cylindrical wall of the first portion is interposed between the electromagnet assembly and the contact section so as to ensure an electrical insulation therebetween.

Each of the contact members in the contact section is provided with a contact portion at one longitudinal end, a terminal portion at another longitudinal end and a fitting portion between the contact and terminal ends. The contact members are securely mounted to the second portion of the base by respectively fitting and inserting the fitting portions thereof in a longitudinal direction along the opposite lateral edges of the fitting portions into the corresponding receptive grooves. In this regard, one, or a break-side, fixed contact member, located close to the electromagnet assembly, is further provided between the fitting portion and the terminal portion with an extending portion extending generally orthogonal to both the fitting and terminal portions. When the break-side fixed contact member is properly fitted to the base, the extending portion is placed on the upper face of a plate-like part formed in the second portion and extending adjacent to the receptive grooves. Then, the first portion of the base is assembled to the second portion by laying the bottom face of the first portion on the extending portion of the break-side fixed contact member and placed on the plate-like part of the second portion. In this manner, the terminal portion of the break-side fixed contact member is located under the first portion of the base and the electromagnet assembly. As a result, it is possible to bring the contact portions of the contact members close to the electromagnet assembly, in comparison with the structure disclosed in JP-U-7-1554, while maintaining predetermined terminal pitches in the contact section, which results in the reduction of the outside dimension of the electromagnetic relay in the direction of the coil center axis.

However, in the above structure, in order to ensure a predetermined insulating distance between the electromagnet assembly and the contact section, it is required to keep the extending portion of the break-side fixed contact member away from the electromagnet assembly by a desired linear distance on the plate-like part of the second portion of the base, on which the extending portion is placed. As a result, the outside dimensions of the electromagnetic relay may be increased in the height direction thereof, otherwise, under the given limitation of the outside dimension, the dimension of the electromagnet in a radial direction of the coil and thus a space for installing a winding may be reduced, which may result in the degradation of a magnetic attraction force. Also, in comparison with the electromagnetic relay including the base having an integral or one-piece structure, the production cost may be increased due to the increased number of parts.

Incidentally, in the conventional electromagnetic relay having such a contact-member assembling structure that the contact members are mounted to the base by respectively fitting and inserting the fitting portions thereof in a longitudinal direction along the opposite lateral edges of the fitting portions into the corresponding receptive grooves formed in the base, the movable contact member having a relatively thinner shape for exhibiting a desired spring performance may especially be subjected to an undesirable deformation resulting in, e.g., a relative positional displacement between the contact and terminal portions, due to a pressing force applied to the movable contact member during the insertion thereof. Therefore, in this case, such a countermeasure has been generally adopted that the movable contact member is formed by fixedly joining two parts with each other, one being a thinner part including the contact portion and the other being a thicker part including the fitting and terminal portions, and that the pressing force during the insertion is loaded to the fitting portion in the thicker part (see, e.g., Japanese Unexamined Patent Publication (Kokai) No. 2000-149749 (JP-A-2000-149749) and U.S. Pat. No. 5,719,541).

However, in this structure, a production cost may be increased due to the increased number of parts, in comparison with the electromagnetic relay including the movable contact member having an integral or one-piece structure. Moreover, it is a general requirement in the conventional electromagnetic relay that the life of contact of each contact member in the contact section is effectively increased.

SUMMARY OF THE INVENTION

It is therefore an object of the present invention to provide an electromagnetic relay capable of ensuring a predetermined insulating distance between an electromagnet assembly and a contact section while maintaining predetermined terminal pitches in the contact section, and of improving a magnetic attraction force of the electromagnet without increasing the outside dimension of the relay, so as to ensure a high structural reliability and stable operating characteristics.

It is another object of the present invention to provide an electromagnetic relay, capable of avoiding the addition of parts, to prevent a production cost from increasing, without affecting a structural reliability and operating characteristics.

It is still another object of the present invention to provide an electromagnetic relay, capable of improving the life of respective contact members provided in a contact section.

In accordance with the present invention, there is provided an electromagnetic relay comprising a base including a receptacle; an electromagnet assembly incorporated in the base; and a contact section incorporated in the base to be actuated by the electromagnet assembly; the contact section including a fixed contact member located away from the electromagnet assembly at at least a predetermined insulating distance and a movable contact member located oppositely to the fixed contact member at a position further away from the electromagnet assembly than the fixed contact member; the fixed contact member being provided with a fixed contact portion, a first terminal portion, a fitting portion arranged between the fixed contact portion and the first terminal portion, the fitting portion being fitted and inserted in a lateral direction into the receptacle of the base, and an extending portion arranged between the fitting portion and the first terminal portion, the extending portion extending to be exposed outside from the receptacle; the movable contact member being provided with a movable contact portion capable of contacting with the fixed contact portion of the fixed contact member and a second terminal portion spaced from the first terminal portion of the fixed contact member; the extending portion of the fixed contact member being shaped and dimensioned to ensure at least the insulating distance and to maintain a predetermined terminal pitch between the first terminal portion of the fixed contact member and the second terminal portion of the movable contact member.

In this electromagnetic relay, it is preferred that the fitting portion of the fixed contact member extends in an angled shape in the receptacle of the base while keeping at least the insulating distance, and cooperates with the extending portion to maintain the terminal pitch.

It is also preferred that the insulating distance is 2 mm, or more, in a straight line.

It is advantageous that the extending portion of the fixed contact member is covered by an adhesive.

The electromagnet assembly may include an electromagnet with a coil; and the fixed contact member and the movable contact member may be arranged side-by-side in a row extending along a coil center axis of the electromagnet, and the extending portion of the fixed contact member extends in a direction generally parallel to the coil center axis.

In this arrangement, the electromagnet assembly may further include an armature driven by the electromagnet and a pair of coil terminal members connected respectively to opposite wire ends of the coil of the electromagnet, the pair of coil terminal members being arranged in a mutually spaced relationship in a direction generally orthogonal to the coil center axis; each of the coil terminal members may be provided with an entwining portion to which a wire end of the coil is securely entwined, a terminal portion projecting outward from the base and a bent portion arranged between the entwining portion and the terminal portion; and the pair of coil terminal members may define a larger space between entwining portions of the coil terminal members than a space between terminal portions of the coil terminal members, the armature being disposed in the larger space between the entwining portions.

Each of the coil terminal members may have a generally circular or regular-polygonal cross-sectional shape.

The electromagnet may include a bobbin for carrying the coil and the pair of coil terminal members, the bobbin being provided with a recess arranged adjacent to each of the coil terminal members for receiving a conductive wire of the coil.

It is also preferred that the base includes a second receptacle for receiving the movable contact member; and that the movable contact member is further provided with a fitting portion arranged between the movable contact portion and the second terminal portion to be fitted and inserted in a lateral direction into the second receptacle of the base, first and second loading portions dispersedly arranged around the movable contact portion to be subjected to a driving force applied from the electromagnet assembly, and a slit formed between the movable contact portion and the first loading portion to facilitate a shifting motion of the movable contact portion relative to the first loading portion.

In this arrangement, the movable contact portion may be spaced from the fitting portion in the movable contact member to define a generally U-shaped peripheral edge laterally opening to a side of the first loading portion.

The movable contact member may be further provided with an auxiliary slit formed between the movable contact portion and the second loading portion to facilitate a shifting motion of the movable contact portion relative to the second loading portion.

The auxiliary slit may be shaped asymmetrically to the slit about the movable contact portion.

The present invention also provides an electromagnetic relay comprising a base including a receptacle; an electromagnet assembly incorporated in the base; and a contact section incorporated in the base to be actuated by the electromagnet assembly; the contact section including a fixed contact member and a movable contact member; the fixed contact member being provided with a fixed contact portion and a first terminal portion; the movable contact member being provided with a movable contact portion capable of contacting with the fixed contact portion of the fixed contact member, a second terminal portion spaced from the first terminal portion of the fixed contact member, a fitting portion arranged between the movable contact portion and the second terminal portion to be fitted and inserted in a lateral direction into the receptacle of the base, first and second loading portions dispersedly arranged around the movable contact portion to be subjected to a driving force from the electromagnet assembly, and a slit formed between the movable contact portion and the first loading portion to facilitate a shifting motion of the movable contact portion relative to the first loading portion.

In this electromagnetic relay, it is preferred that the slit of the movable contact member defines an elastic arm including the first loading portion and disposed around the movable contact portion, the elastic arm being provided with a proximal end length extending adjacent to the generally U-shaped peripheral edge.

In this arrangement, the proximal end length of the elastic arm may extend in a curved manner adjacent to the generally U-shaped peripheral edge.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENT

Figure 1:
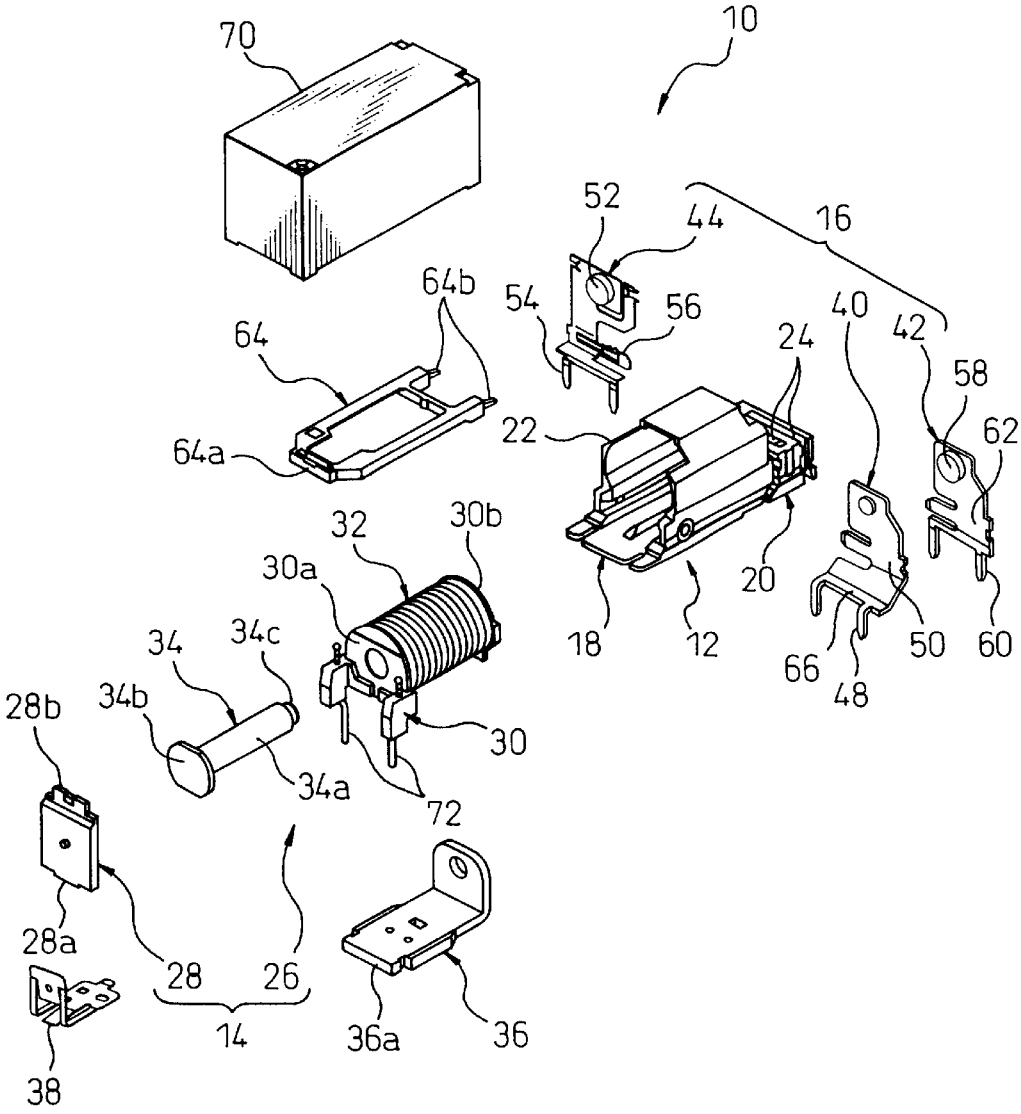
FIG. 1 is an exploded perspective view showing an electromagnetic relay, according to an embodiment of the present invention.
Figure 2:
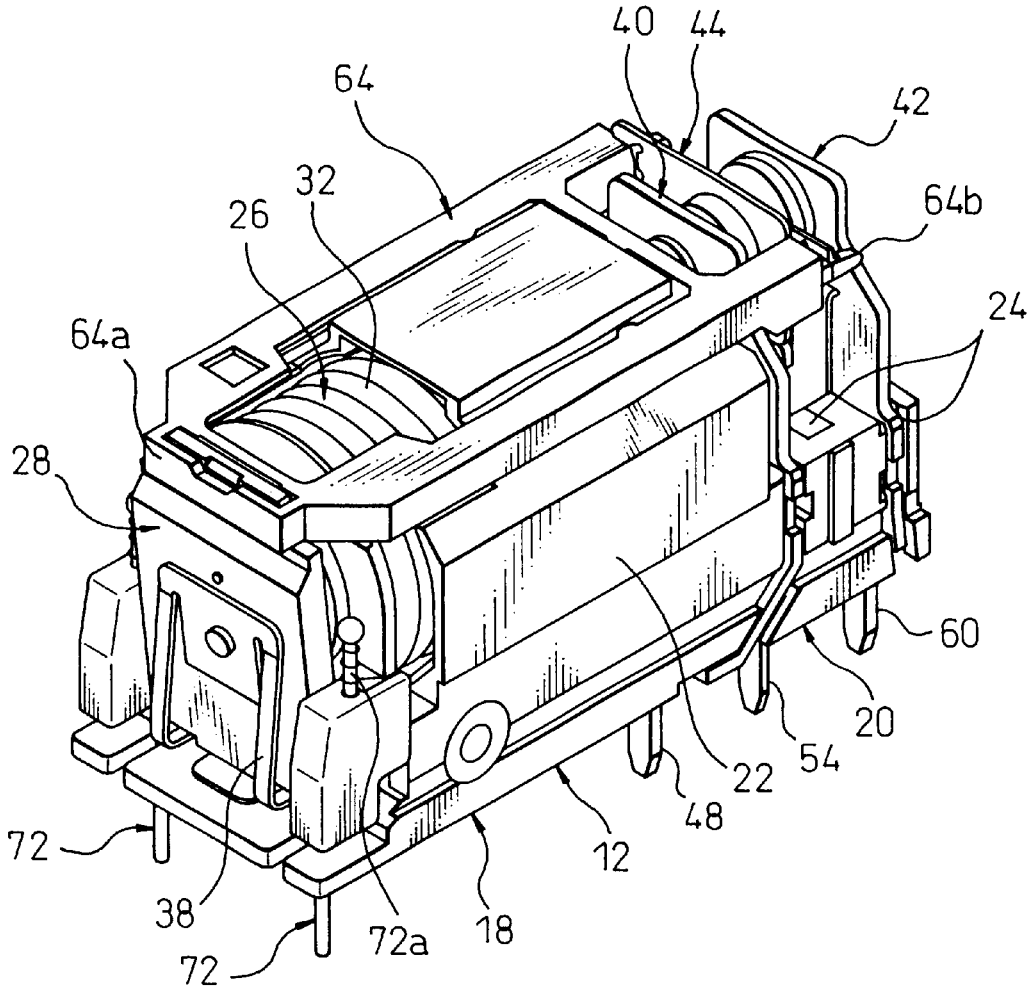
FIG. 2 is a perspective view showing the electromagnetic relay of FIG. 1 in an assembled state with no casing.
Figure 3:
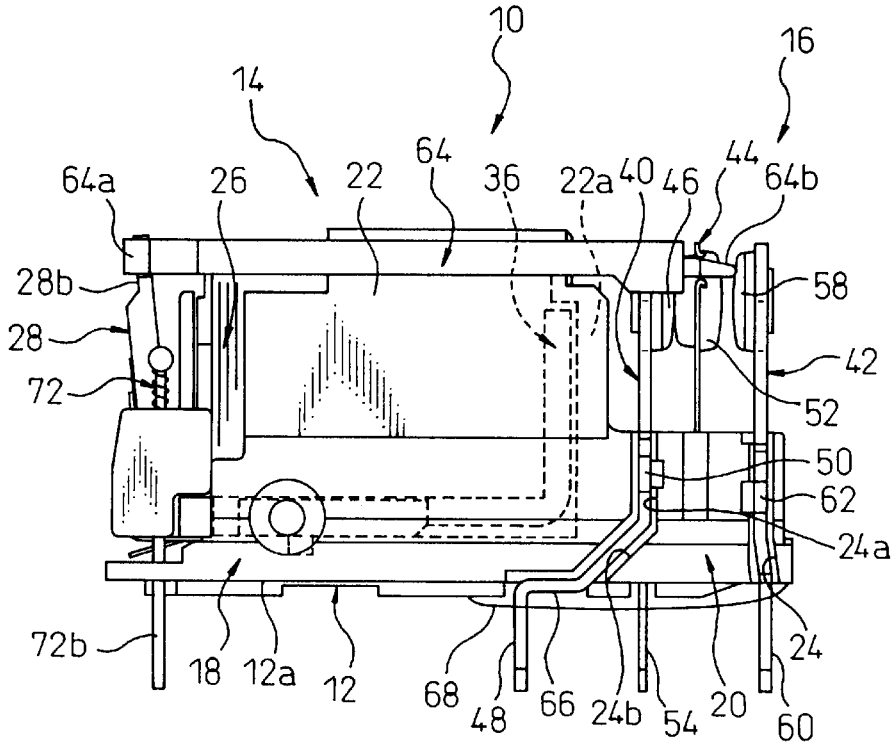
FIG. 3 is a front view showing the electromagnetic relay of FIG. 2.

Referring now to the drawings, in which the same or similar components are denoted by common reference numerals, FIG. 1 shows an electromagnetic relay 10, according to an embodiment of the present invention, in an exploded perspective manner, and FIGS. 2 and 3 show the electromagnetic relay 10 in mutually different orientations with a casing removed. The electromagnetic relay 10 includes a base 12, an electromagnet assembly 14 incorporated with the base 12, and a contact section 16 incorporated with the base 12 and adapted to be actuated by the electromagnet assembly 14 to perform a make/break operation.

The base 12 is formed from an electrically insulating resinous molding, and is provided integrally with a first portion 18 for the installation of the electromagnet assembly 14 and a second portion 20 for the installation of the contact section 16. The first portion 18 includes a cylindrical wall 22 for surrounding a part of the electromagnet assembly 14. The second portion 20 includes a plurality of receptive grooves or receptacles 24 for individually receiving a plurality of contact members in the contact section 16 as described later. The cylindrical wall 22 provided in the first portion 18 is interposed between the electromagnet assembly 14 and the contact section 16 so as to ensure an electrical insulation therebetween.

Figure 4:
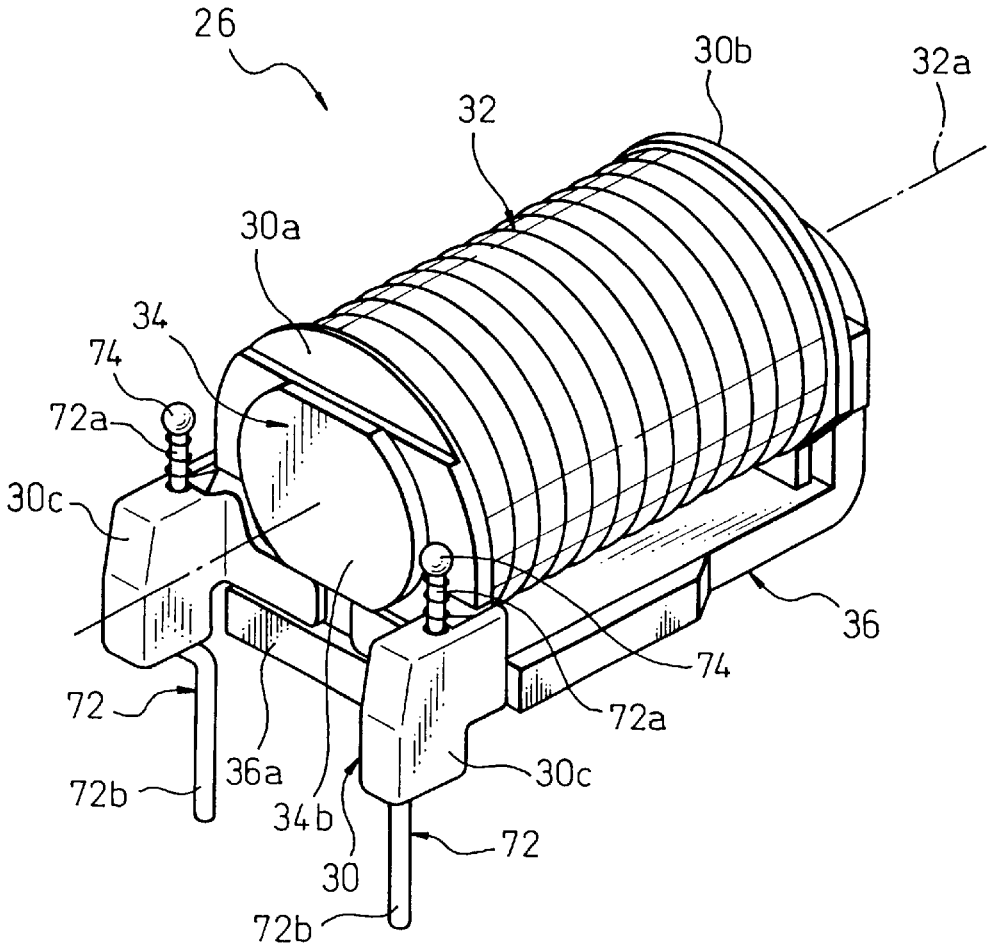
FIG. 4 is a perspective view showing an electromagnet incorporated in the electromagnetic relay of FIG. 1.

The electromagnet assembly 14 includes an electromagnet 26 and an armature 28 driven by the electromagnet 26. As shown in FIG. 4 in an enlarged manner, the electromagnet 26 includes a bobbin 30, a coil 32 having a center axis 32*a* and wound to be carried on the bobbin 30, and an iron core 34 supported on the bobbin 30 to be disposed along the center axis 32*a* of the coil 32. The bobbin 30 is formed from an electrical insulating resinous mold, and is provided integrally with a hollow body (not shown) having a predetermined length, a pair of annular flanges 30*a*, 30*b* formed respectively at the longitudinal opposite ends of the body, and a pair of terminal supports 30*c* disposed at symmetrical positions on the periphery of one flange 30*a* and extending therefrom in the longitudinal direction of the body.

The coil 32 is formed by winding a predetermined length of a conductive wire tightly onto the body of the bobbin 30, and is securely held between the flanges 30*a*, 30*b* of the bobbin 30. The iron core 34 is a bar-shaped member formed from, e.g., a magnetic steel. A generally cylindrical major part 34*a* of the iron core 34 is fixedly received within the body of the bobbin 30 and is arranged coaxially with the center axis 32*a* of the coil 32. The iron core 34 is provided integrally at one axial end thereof with a head 34*b* having a flat end face extending generally orthogonal to the coil center axis 32*a*, and the head 34*b* is exposed outside of the flange 30*a* of the bobbin 30. Also, the other axial end 34*c* of the iron core 34 projects outward from the other flange 30*b* of the bobbin 30.

A yoke 36 is fixedly joined to the other axial end 34*c* of the iron core 34 of the electromagnet 26 through, e.g., a caulking or a plastic deformation of the material of the core 34, so as to form a magnetic path or circuit around the coil 32. The yoke 36 is a L-shaped plate-like member formed from, e.g., a magnetic steel. The yoke 36 is arranged so that the shorter length part thereof extends along the flange 30*b* of the bobbin 30 and the longer length part thereof extends along the coil 32 generally in parallel to the coil center axis 32*a* so as to be laterally spaced from the coil 32. The distal free end 36*a* of the longer length part of the yoke 36 is located close to the head 34*b* of the iron core 34, and the armature 28 is pivotably connected to the free end 36*a*.

The armature 28 is a flat plate-like member formed from, e.g., a magnetic steel. The armature 28 is connected through a plate spring 38 to the yoke 36 in an elastically shiftable manner relative to the yoke 36, and is disposed oppositely to the head 34*b* of the iron core 34. The plate spring 38 acts as an elastic hinge between the yoke 36 and the armature 28, and elastically biases or urges the armature 28 in a direction away from the head 34*b* of the iron core 34 due to an inherent spring action of the plate spring 38.

The armature 28 is abutted at one end (the bottom end, in the drawing) 28*a* thereof onto the free end 36*a* of the yoke 36 under the spring or biasing force of the plate spring 38, so that, during a period when the electromagnet 26 is not excited, the armature 28 is held in a stationary state at an initial or released position (FIG. 3) spaced away from the head 34*b* of the iron core 34 at a predetermined distance. When the electromagnet 26 is excited, the armature 28 is shifted or pivoted toward the core head 34*b* against the biasing force of the plate spring 38 due to a magnetic attraction force, about a mutually engaging point between the armature bottom end 28*a* and the yoke free end 36*a*.

The contact section 16 includes a pair of fixed contact members 40, 42 arranged side-by-side along the center axis 32*a* of the coil 32 of the electromagnet 26 and spaced at a predetermined distance from each other, and a movable contact member 44 arranged between the fixed contact members 40, 42 and spaced at a predetermined distance from the latter. Each of the fixed contact members 40, 42 is a conductive plate member formed by, e.g., punching a copper plate into a predetermined shape. Also, the movable contact member 44 is a conductive plate member formed by, e.g., punching a spring sheet of phosphor bronze into a predetermined shape.

The first fixed contact member 40 located close to the electromagnet assembly 14 is disposed at a position away from the armature 28 in a coil-axis direction so as to be opposed to the yoke 36 of the electromagnet 26 with an end wall part 22*a* (FIG. 3) of the cylindrical wall 22 of the base 12 being interposed between the fixed contact member 40 and the yoke 36. The first fixed contact member 40 is separated from the yoke 36, i.e., from the electromagnet assembly 14 at at least a predetermined linear insulating distance. The movable contact member 44 is located opposite to the first fixed contact member 40 at a position further away from the electromagnet assembly 14 in the coil-axis direction than the first fixed contact member 40. The second fixed contact member 42 is located opposite to the movable contact member 44 at a position further away from the first fixed contact member 40 in the coil-axis direction than the movable contact member 44.

Figure 5:
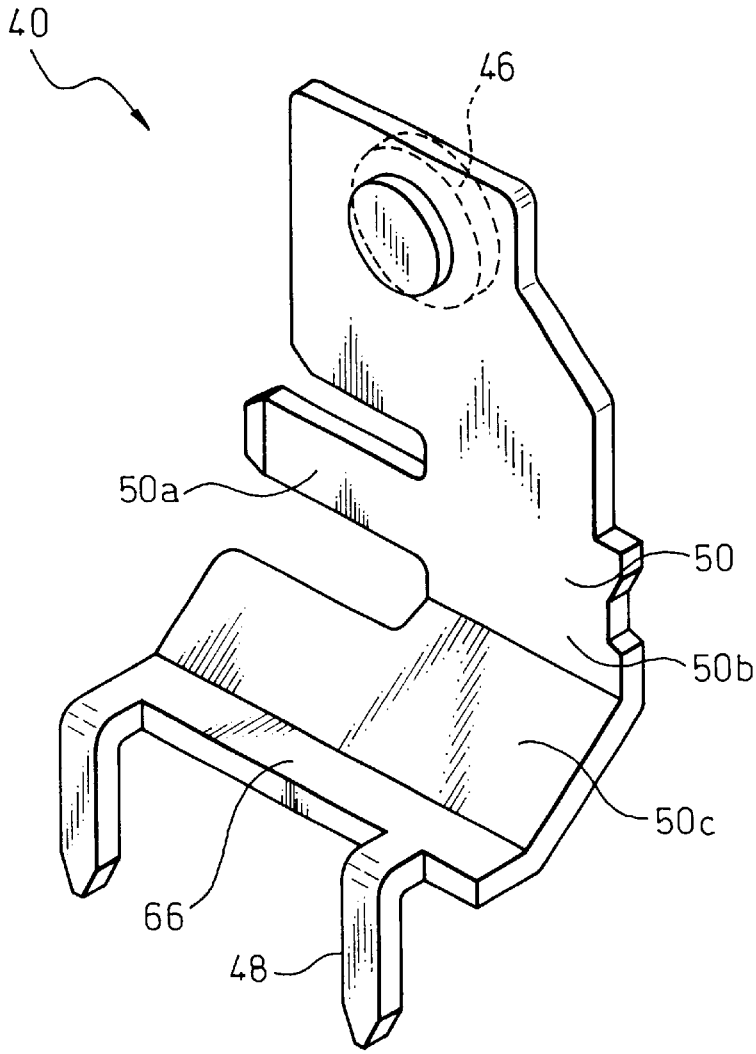
FIG. 5 is a perspective view showing a first fixed contact member incorporated in the electromagnetic relay of FIG. 1.

The first fixed contact member 40 is provided with a fixed contact portion 46 at one longitudinal end, a first terminal portion 48 at another longitudinal end and a fitting portion 50 arranged between the fixed contact portion 46 and the first terminal portion 48 (see FIG. 5). The movable contact member 44 is provided with a movable contact portion 52 at one longitudinal end, a second terminal portion 54 at another longitudinal end and a fitting portion 56 arranged between the movable contact portion 52 and the second terminal portion 54 (see FIG. 6). The second fixed contact member 42 is provided with a fixed contact portion 58 at one longitudinal end, a third terminal portion 60 at another longitudinal end and a fitting portion 62 arranged between the fixed contact portion 58 and the third terminal portion 60 (see FIG. 7).

Each of the fixed contact portions 46, 58 of the fixed contact members 40, 42 is made of a desired material generally suitable for a contact point, and is joined to each fixed contact member 40, 42 so as to protrude from one surface of the latter. The movable contact portion 52 of the movable contact member 44 is made of a desired material generally suitable for a contact point, and is joined to the movable contact member 44 so as to protrude from opposite surfaces of the latter. Each of the first, second and third terminal portions 48, 54, 60 of the fixed and movable contact members 40, 44, 42 is formed as a pair of legs in the illustrated embodiment, but may be structured as a single leg or as three or more legs in accordance with the application of the electromagnetic relay 10.

The fixed and movable contact members 40, 44, 42 are securely mounted to the second portion 20 of the base 12 by respectively fitting and inserting the fitting portions 50, 56, 62 thereof in a lateral direction from one lateral edges of the fitting portions 50, 56, 62 into the corresponding receptive grooves 24. In this respect, the fitting portions 50, 56, 62 of the fixed and movable contact members 40, 44, 42 are provided respectively with press-fitting pieces 50*a*, 56*a*, 62*a* laterally extending and adapted to be press-fitted into recesses (not shown) formed in the corresponding receptive grooves 24.

The fixed contact portions 46, 58 of the first and second fixed contact members 40, 42 are respectively located at substantially unchangeable predetermined positions above the second portion 20 of the base 12. The movable contact portion 52 of the movable contact member 44 is located at a position, above the second portion 20 of the base 12, allowing the movable contact portion 52 to be deviated so as to alternately contact with the fixed contact portions 46, 58 disposed at opposite locations relative to the movable contact portion 52, or to close the contacts, in accordance with the pivoting motion of the armature 28.

On the other hand, the first and third terminal portions 48, 60 of the first and second fixed contact members 40, 42 as well as the second terminal portion 54 of the movable contact member 44 project outward or downward from the second portion 20 of the base 12, and are located in a linear array extending in a direction parallel to the coil center axis 32*a* (FIG. 4) of the electromagnet 26 at predetermined intervals or pitches larger than the intervals of the contact portions 46, 52, 58. In the illustrated embodiment, the first fixed contact member 40 disposed close to the electromagnet assembly 14 constitutes a break contact, and the second fixed contact member 42 disposed away from the electromagnet assembly 14 constitutes a make contact.

The movable contact member 44 is linked to the armature 28 through a link member 64 made of an electrical insulating material. The link member 64 is formed as a frame-shaped member integrally molded from, e.g., a resinous material. The link member 64 is joined at one longitudinal end 64*a* thereof to the free end (the upper end, in the drawing) 28*b* of the armature 28 at a location away from the yoke 36, and at another longitudinal end 64*b* to the free end (the upper end, in the drawing) of the movable contact member 44 at a location away from the base 12. The link member 64 is moved to reciprocate in a direction substantially parallel to the coil center axis 32*a* (FIG. 4) in such a manner as to follow or interlock with the pivoting motion of the armature 28 caused by the excitation/de-excitation of the electromagnet 26, and thereby transmits the pivoting motion of the armature 28 to the movable contact member 44 as described below.

In the initial or released position as shown in FIG. 3, the armature 28 is held to be spaced away from the head 34*b* of the iron core 34 at a predetermined distance, under the biasing force of the plate spring 38, as already described. In this state, the link member 64 is located at one limit position in the reciprocating range, and the movable contact member 44 joined to the end 64*b* of the link member 64 is in an unloaded form with substantially no elastic deformation. Thus, the movable contact portion 52 of the movable contact member 44 is kept in contact with the fixed contact portion 46 of the fixed contact member 40 so as to establish an electrical conduction therebetween, whereby the break contact is closed.

When the electromagnet 26 is excited, the armature 28 is pivoted or shifted from the released position of FIG. 3 toward the core head 34*b* due to the magnetic attraction force, against a spring force caused mainly by the elastic deformation of the movable contact member 44, about the mutually engaging point between the armature bottom end 28*a* and the yoke free end 36*a*. During this shifting motion, the link member 64 is moved toward another limit position in the reciprocating range, so as to elastically bend or deform the movable contact member 44 in a direction toward the second fixed contact member 42. At an instant when the armature 28 is completely absorbed on the core head 34*b*, the link member 64 reaches the other limit position in the reciprocating range, and the movable contact portion 52 comes into tight contact with the fixed contact portion 58 so as to establish an electrical conduction therebetween, whereby the make contact is closed.

The electromagnetic relay 10 as described above is capable of ensuring a predetermined insulating distance between the electromagnet assembly 14 and the contact section 16 while maintaining the predetermined terminal pitches in the contact section 16. For example, in the case where the electromagnetic relay 10 is used as a general-purpose power relay capable of being installed in various industrial equipment, it is required to ensure the insulating distance (2 mm in a straight line or a linear distance) following Verband Deutscher Elecktrotechniker (VDE) Standard 0631. Moreover, the electromagnetic relay 10 adopts characteristic features, as described below, for enabling the relay 10 to follow certain Standards, such as VDE Standard, under given limitations of outside dimensions.

As shown in FIG. 3, the electromagnetic relay 10 is provided with the first receptive groove 24, among three receptive grooves 24 formed in the second portion 20 of the base 12, which includes a vertical area 24*a* extending in a direction generally perpendicular to the coil center axis 32*a* (FIG. 4) of the electromagnet 26 so as to open to the upper side of the base 12, and an inclined area 24*b* joined to the vertical area 24*a* with an obtuse angle defined therebetween and extending toward the first portion 18 of the base 12 so as to open to the lower side 12*a* of the base 12.

On the other hand, the first fixed contact member 40 in the contact section 16 is provided with the fitting portion 50 shaped and dimensioned so as to correspond to the above-described angled shape of the first receptive groove 24. Therefore, the fitting portion 50 includes a vertical length 50*b* having the press-fitting piece 50*a*, and an inclined length 50*c* joined to the vertical length 50*b* with an obtuse angle defined therebetween and extending away from the fixed contact portion 46. The fixed contact member 40 is further provided with an extending portion 66 arranged between the inclined length 50*c* of the fitting portion 50 and the first terminal portion 48. As shown in FIGS. 3 and 5, the extending portion 66 extends generally perpendicularly to both the vertical length 50*b* of the fitting portion 50 and the first terminal portion 48.

When the first fixed contact member 40 is properly fitted into the first receptive groove 24 in the base 12, the fitting portion 50 of the fixed contact member 40 extends in a bending manner along the receptive groove 24 while establishing at least a predetermined insulating distance relative to the electromagnet assembly 14, and the extending portion 66 is exposed outside from the receptive groove 24 and extends along the lower side 12*a* of the base 12 in a direction toward the first portion 18. In this arrangement, the extending portion 66 is located in generally parallel to the coil center axis 32*a* of the electromagnet 26 while establishing at least a predetermined insulating distance relative to the electromagnet assembly 14.

The first terminal portion 48 of the first fixed contact member 40 is offset or deviated from the fixed contact portion 46 and the vertical length 50*b* of the fitting portion 50 in a direction toward the first portion 18 of the base 12, due to the cooperation of the inclined length 50*c* of the fitting portion 50 and the extending portion 66, so that the first terminal portion 48 is located at a position substantially under the electromagnet assembly 14 (see FIG. 3). As a result, in the contact section 16, the first and third terminal portions 48, 60 of the first and second contact members 40, 42 and the second terminal portion 54 of the movable contact member 44 are arranged at regular intervals to maintain predetermined terminal pitches therebetween on the lower side 12*a* of the base 12.

According to the above configuration, in the electromagnetic relay 10, the fixed contact portions 46, 58 of the fixed contact members 40, 42 and the movable contact portion 52 of the movable contact member 44 are located closely to the electromagnet assembly 14 as much as possible, while maintaining predetermined terminal pitches in the contact section 16, and thereby the outside dimension of the electromagnetic relay 10 is capable of being reduced in the direction of the coil center axis 32*a*. In spite of such a reduction in the outside dimension, it is possible to ensure a predetermined insulating distance, such as 2 mm or more in a straight line as following the VDE Standard 0631, between the electromagnet assembly 14 and the first fixed contact member 40. Furthermore, because the extending portion 66 of the first fixed contact member 40 is exposed on the lower side 12*a* of the base 12, most of the insulating distance is obtainable due to the effective thickness of the corresponding area of the base first portion 18, interposed between the extending portion 66 and the electromagnet assembly 14. Therefore, the outside dimension of the electromagnetic relay 10 is also effectively prevented from being increased in the height direction thereof. Alternatively, under the given limitation of the outside dimension, it is possible to increase the dimension of the electromagnet 26 in the radial direction of the coil 32 and thus to enlarge a space for the installation of a winding, which enhances a magnetic attraction force, in comparison with the conventional electromagnetic relay. Whereby, it is possible to provide the electromagnetic relay 10 with a high structural reliability and stable operating characteristics.

Further, in the electromagnetic relay 10, the fitting portions 50, 62 of the first and second fixed contact members 40, 42 and the fitting portion 56 of the movable contact member 44 are respectively fitted or inserted in a lateral direction into the corresponding receptive grooves 24 in the base second portion 20, so that it is possible to form the base 12 as a one-piece structure including integrally the first and second portions 18, 20, in spite of the fact that the first terminal portion 48 of the first fixed contact member 40 is positioned under the base first portion 18. Also, even in the movable contact member 44 having a relatively thinner shape for exhibiting a desired spring performance, the pressing force applied to the fitting portion 56 in the lateral direction during the insertion thereof into the receptive groove 24 is sufficiently low to surely avoid an undesirable deformation of the movable contact member 44, which otherwise may result in, e.g., a relative positional displacement between the movable contact portion 52 and the second terminal portion 54, so that it is possible to form the movable contact member 44 as a one-piece structure including integrally the movable contact and second terminal portions 52, 54. Consequently, in the electromagnetic relay 10, it is possible to avoid the increase of the number of parts and thus to prevent a production cost from increasing, without affecting a structural reliability and operating characteristics.

In the above-described configuration, it is advantageous that the extending portion 66 of the first fixed contact member 40 is covered, preferably as a whole, by an adhesive 68 (FIG. 3) used for fixedly attaching the contact members 40, 42, 44 to the base 12, from a viewpoint of enhancing the external-insulating and pollution-proofing performance of the fixed contact member 40. Such a covering by the adhesive 68 may be provided through a conventional process for applying the adhesive, whereby the number of steps in the production process is prevented from being increased. The main structure assembled through the above process is accommodated in a casing 70 as shown in FIG. 1, so that the electromagnetic relay 10 is completed as a product.

Figure 8:
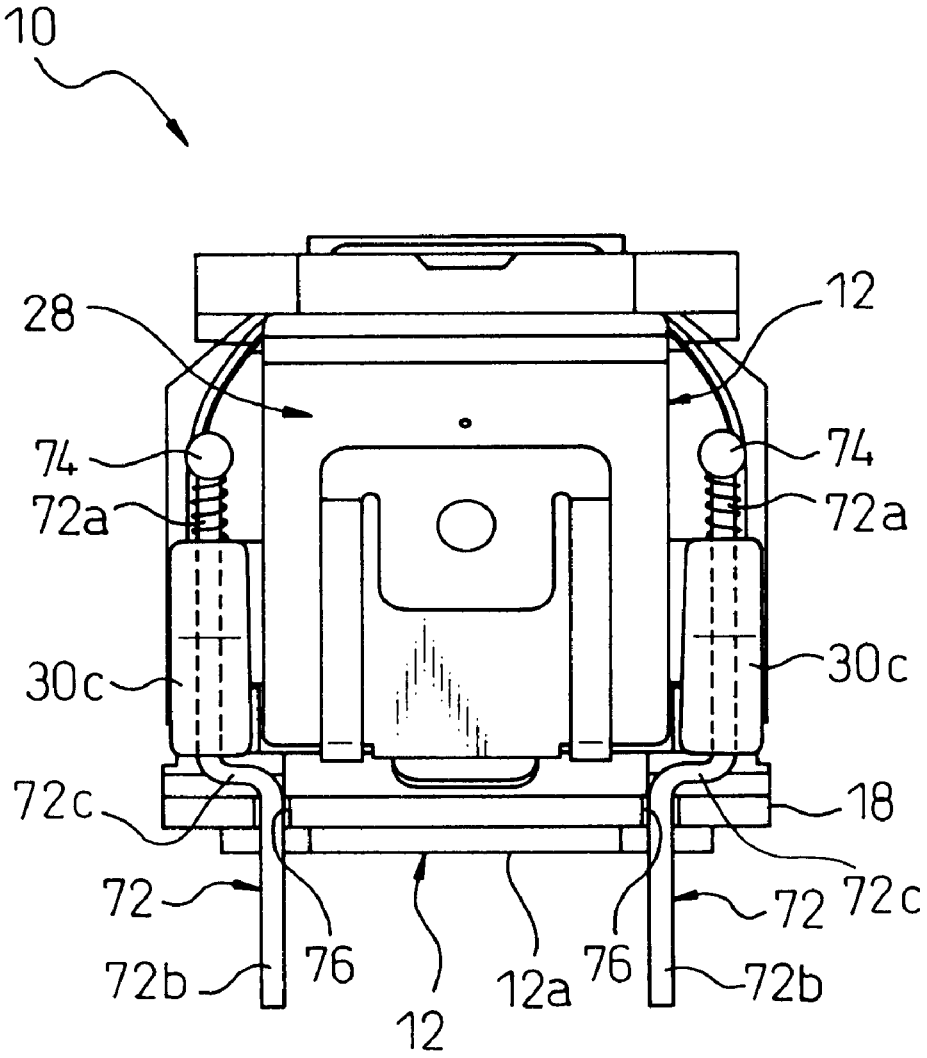
FIG. 8 is a side view showing the electromagnetic relay of FIG. 2.

In the electromagnetic relay 10, another alternative measure is adopted for enhancing the magnetic attraction force of the electromagnet 26 in the electromagnet assembly 14 under the given limitation of the outside dimension of the relay. As seen from FIGS. 4 and 8, a pair of coil terminal members 72 formed from good electrical conductors are securely mounted onto the respective terminal supports 30*c* formed in the bobbin 30 of the electromagnet 26 in such a configuration as to be spaced from each other in a direction substantially orthogonal to the coil center axis 32*a*. The conductive wire forming the coil 32 is connected, at the opposite ends thereof, with the respective coil terminal members 72.

Each of the coil terminal members 72 is provided integrally with an entwining portion 72*a* projecting upward from the corresponding terminal support 30*c* in the bobbin 30 to a location laterally close to the core head 34*b*, and a terminal portion 72*b* projecting downward from the terminal support 30*c*. The opposite wire ends of the coil 32 are entwined to the respective entwining portions 72*a* of the coil terminal members 72 and are fixed thereto by, e.g., solders 74. The terminal portions 72*b* of the coil terminal members 72 pass through respective slots 76 formed in the first portion 18 of the base 12 for installation of the electromagnet assembly 14 and project outside the electromagnetic relay 10. The terminal portions 72*b* of the coil terminal members 72 are spaced at a predetermined distance or terminal pitch from each other along the lower side 12*a* of the base 12.

Each coil terminal member 72 is further provided with a bent portion 72*c* arranged between the entwining portion 72*a* and the terminal portion 72*b* (e.g., a portion just under the corresponding terminal support 30*c* as illustrated), which is bent at two points into respective generally right angles in the opposite directions, i.e., into a cranked shape. In this regard, the entwining portion 72*a* extends in generally parallel to the terminal portion 72*b*. The coil terminal members 72 are mounted to the corresponding terminal supports 30*c* in such an orientation as to define a larger space between the entwining portions 72*a* than a space between the terminal portions 72*b*.

According to this arrangement, it is possible to enlarge the space between the entwining portions 72*a* of the coil terminal members 72 while maintaining a predetermined terminal pitch between the terminal portions 72*b*, and thereby to increase the dimension of the armature 28, disposed oppositely to the core head 34*b* between the entwining portions 72*a*, in especially the lateral direction. In this regard, if the space between the entwining portions 72*a* of the coil terminal members 72 is enlarged within a dimensional restriction for preventing the coil terminal members 72 from laterally protruding outward from the flange 30*a* of the bobbin 30, it is possible to effectively enhance the magnetic attraction force of the electromagnet 26, under a given limitation of the outside dimension of the electromagnetic relay 10, by increasing the cross-sectional area of a magnetic path defined by the armature 28 as one of magnetic-circuit components.

In the above-described structure, it is preferred that each of the coil terminal members 72 has a generally circular or regular-polygonal cross-sectional shape. According to this arrangement, a counterpart contact member, such as a connector, a socket, a circuit board, adapted to be connected to the coil terminal member 72, may advantageously have any configuration, such as shape or orientation, of contacts.

Figure 9A:
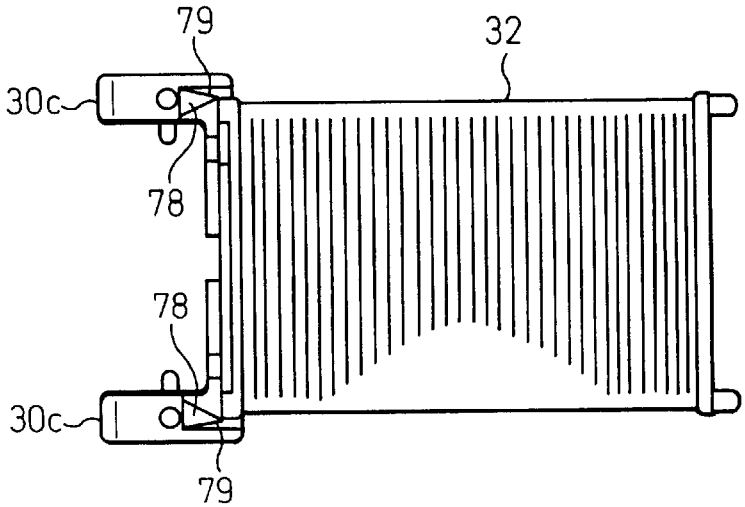
FIG. 9A is a plan view showing a major portion of the electromagnet incorporated in the electromagnetic relay of FIG. 1.
Figure 9B:
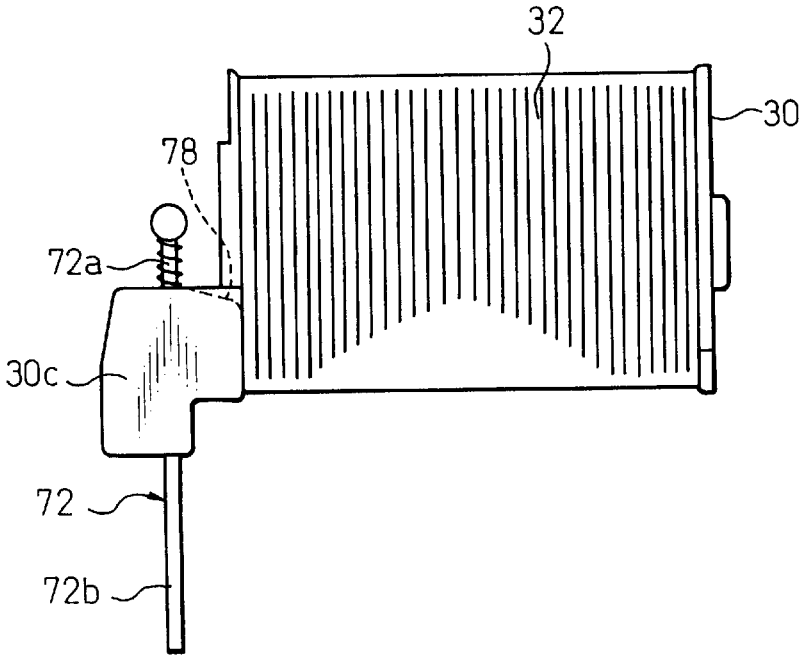
FIG. 9B is a front view showing the major portion of the electromagnet of FIG. 9A.

Also, in the electromagnetic relay 10, it is advantageous that the bobbin 30 of the electromagnet 26 is provided in the respective terminal supports 30*c* with recesses 78 arranged adjacent to the corresponding coil terminal members 72 for individually receiving the conductive wire of the coil 32 (see FIGS. 9A and 9B). When the opposite ends of the conductive wire of the coil 32 are properly fixed to the entwining portions 72*a* of the coil terminal members 72, certain wire lengths 79 adjacent to the opposite ends of the conductive wire are respectively received in the recesses 78 of the terminal supports 30*c*. According to this arrangement, it is possible to substantially eliminate the possibility of careless breakage of the wire lengths 79 during the assembly of the electromagnet 26 as well as of the electromagnetic relay 10.

Figure 6:
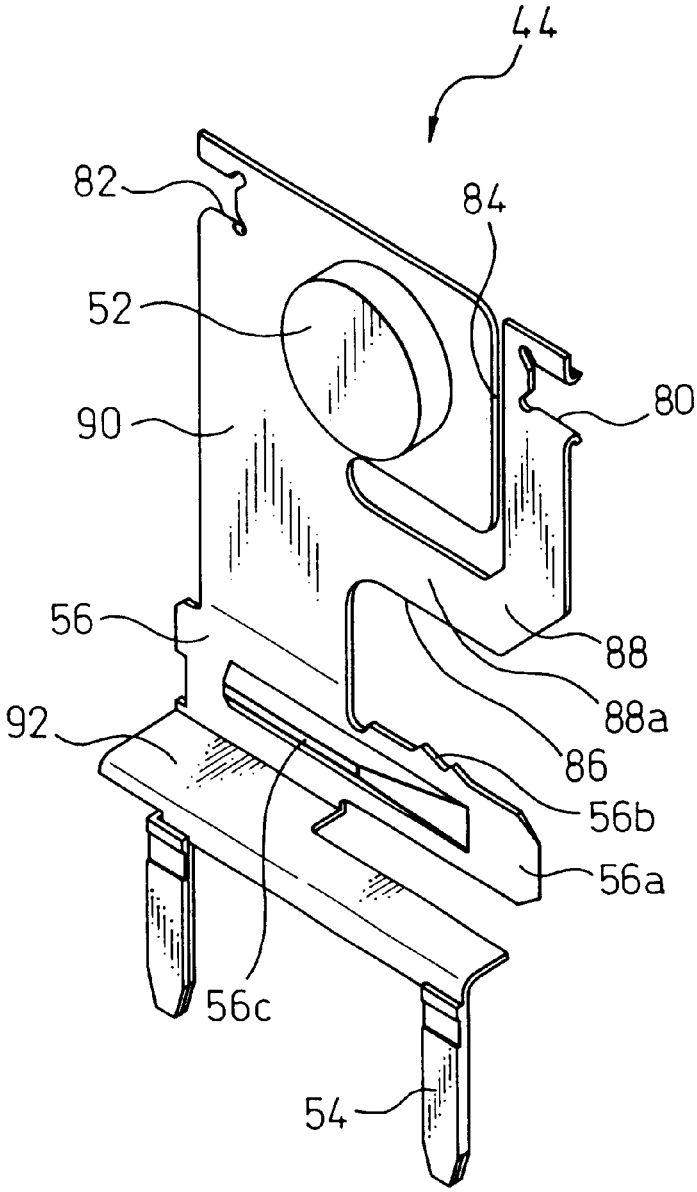
FIG. 6 is a perspective view showing a movable contact member incorporated in the electromagnetic relay of FIG. 1.
Figure 7:
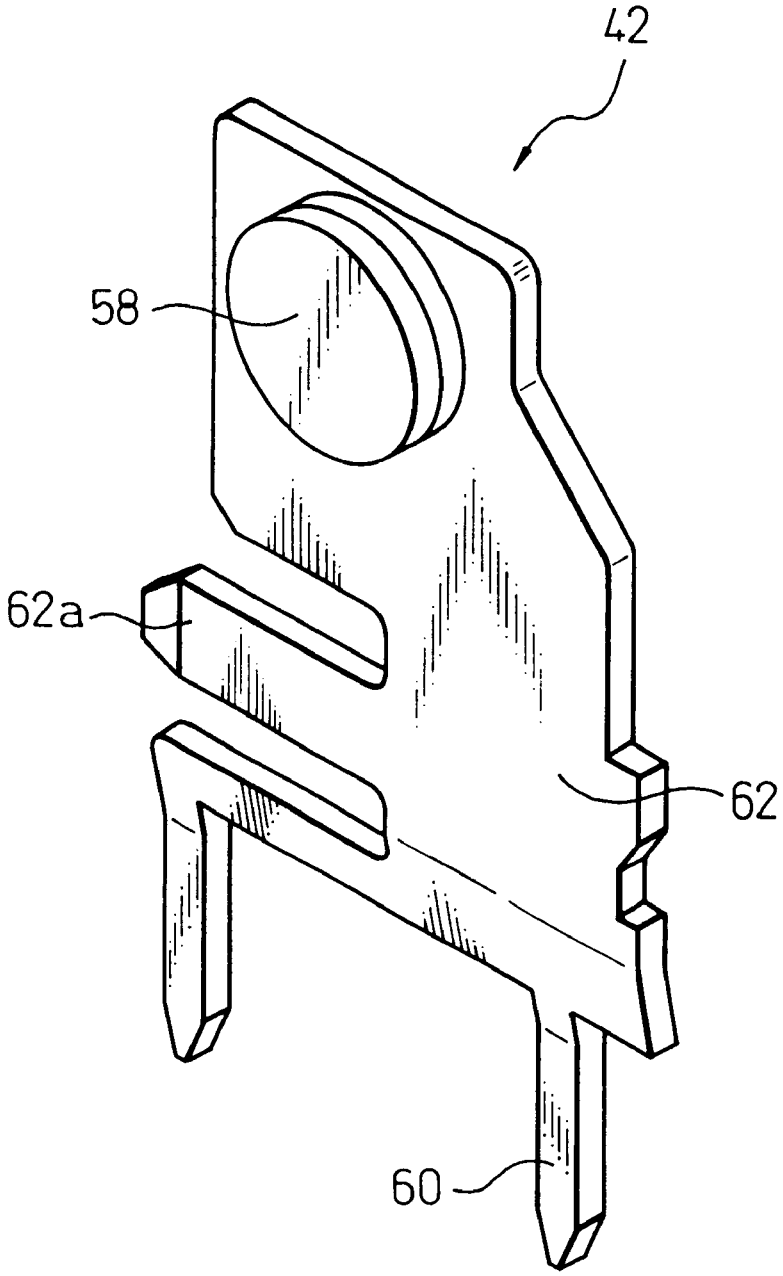
FIG. 7 is a perspective view showing a second fixed contact member incorporated in the electromagnetic relay of FIG. 1.
Figure 10:
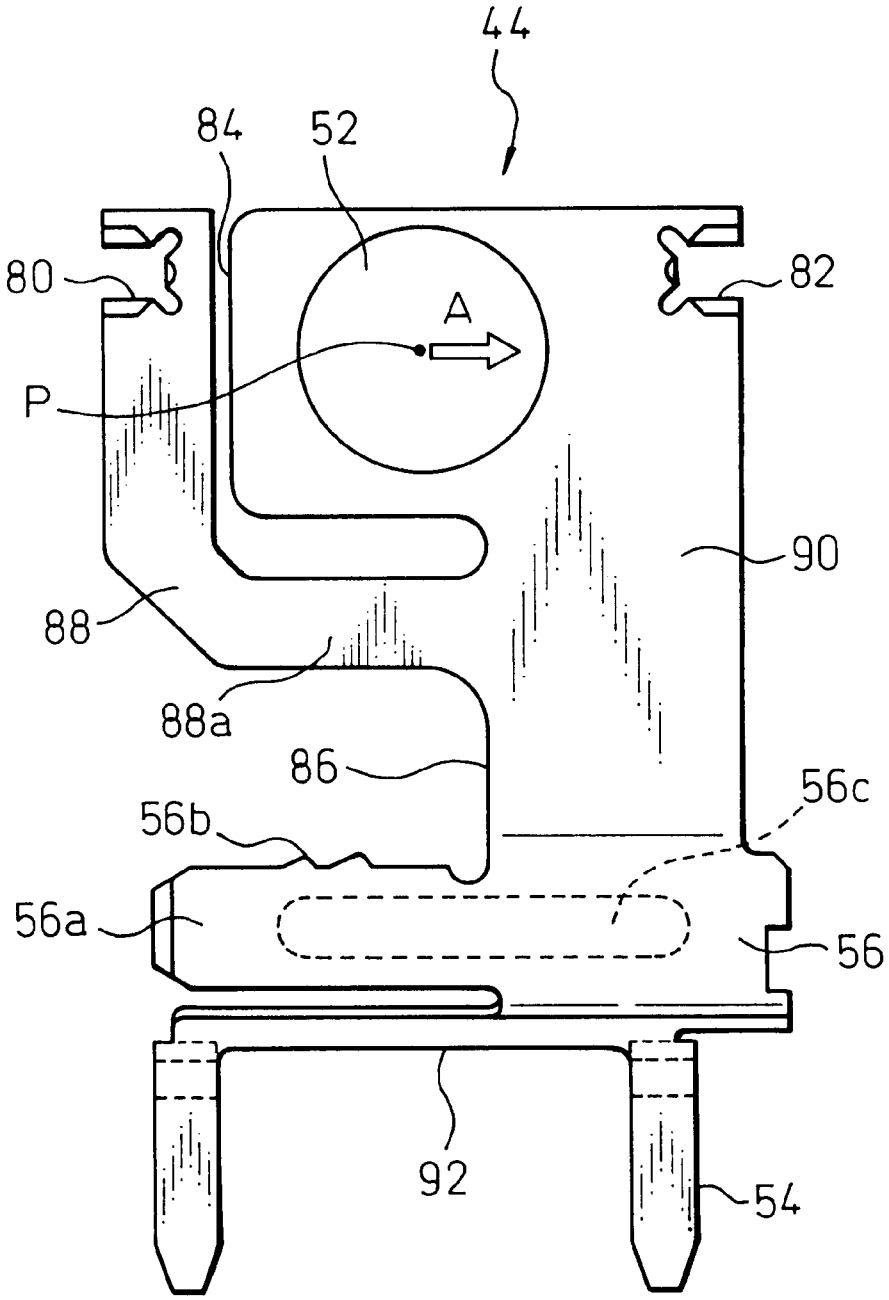
FIG. 10 is a front view showing the movable contact member of FIG. 6.

The electromagnetic relay 10 also possesses another characteristic feature for effectively improving the life of contact of each contact member 40, 42, 44 in the contact section 16, as described below. As shown in FIGS. 6 and 10, the movable contact member 44 is further provided with first and second loading portions 80, 82 dispersedly arranged around the movable contact portion 52, and a main slit 84 formed in a certain area between the movable contact portion 52 and the first loading portion 80 to facilitate a shifting motion of the movable contact portion 52 relative to the first loading portion 80. The first and second loading portions 80, 82 respectively include generally rectangular notches provided in the free end region of the movable contact member 44 along the opposite side edges thereof. Two protrusions constituting the longitudinal end 64*b* of the link member 64 (see FIG. 1) are respectively fitted in the notches of the loading portions 80, 82. Consequently, a driving force generated by the electromagnet assembly 14 is loaded, through the link member 64, onto the first and second loading portions 80, 82 of the movable contact member 44 in a substantially equally distributed manner.

The main slit 84 extends, generally in an L-shape, from the top edge of the movable contact member 44 to a location beneath the movable contact portion 52 of the latter, in the area between the movable contact portion 52 and the first loading portion 80. Also, the movable contact portion 52 is spaced from the fitting portion 56 in the movable contact member 44 to define a generally U-shaped peripheral edge 86 laterally opening to a side of the first loading portion 80. As a result, an L-shaped elastic arm 88 including the first loading portion 80 is formed at a location around the movable contact portion 52. The elastic arm 88 is integrally joined to a major portion 90 extending between the movable contact and fitting portions 52, 56 of the movable contact member 44. A certain proximal-end length 88*a* of the arm 88 is arranged in generally parallel to the press-fitting piece 56*a* of the fitting portion 56 while defining the peripheral edge 86 therebetween.

The fitting portion 56 of the movable contact member 44 is also provided with a serrated edge 56*b* arranged on the press-fitting piece 56*a* along a part of the peripheral edge 86, and with a laterally extending ridge 56*c* protruding from one surface of the press-fitting piece 56*a*. The serrated edge 56*b* and the ridge 56*c* cooperate with each other to firmly fix and accurately position the press-fitting piece 56*a* within the recess (not shown) formed in the receptive groove 24 of the base 12. Moreover, an extending portion 92 is provided between the fitting portion 56 and the second terminal portion 54, so as to extend generally perpendicularly to both the fitting and second terminal portions 56, 54. The extending portion 92 serves to offset or deviate the second terminal portion 54 of the movable contact member 44 from the movable contact portion 52 in a direction toward the first portion 18 of the base 12, in the same manner as the extending portion 66 of the first fixed contact member 40.

As already described, the movable contact member 44 is subjected to the driving force through the link member 64, during the travel of the armature 28 in the electromagnet assembly 14, so as to be elastically bent about the fitting portion 56. In particular, during a period when the movable contact member 44 moves to close a make contact, i.e., to come into contact with the opposed second fixed contact member 42 due to the magnetic attraction force caused by the electromagnet 26, the movable contact member 44 exerts a predetermined spring force against the magnetic attraction force, from an instant when the movable contact portion 52 contacts the fixed contact portion 58 until an instant when the armature 28 is fully attracted to be abutted onto the core head 34*b* of the electromagnet 26. When the electromagnet 26 is de-excited, the movable contact member 44 moves back to the unloaded form to close a break contact, i.e., to come into contact with the opposed first fixed contact member 40, mainly due to the elastic recovery of the movable contact member 44.

During the shifting motion for closing the make contact, the movable contact member 44 presents such an elastic deformation mode, until the armature 28 is fully magnetically attracted, that, mainly, the proximal-end length 88*a* of the elastic arm 88 is elastically bent and the major portion 90 is elastically twisted or distorted relative to the fitting portion 56, under a pushing force applied through the link member 64 from the electromagnet assembly 14 substantially equally onto the first and second loading portions 80, 82, as well as under a pushing force applied in a reverse direction from the contacted, fixed contact portion 58 onto the movable contact portion 52. Such an elastic distortion of the major portion 90 is caused due to the provision of the main slit 84 which substantially divides the movable contact portion 52 from the first loading portion 80 so as to allow them to be independently moved relative to each other. Thereby, the movable contact portion 52 is pivotally shifted in an elastic manner substantially about the second loading portion 82. As a result, a contact point P contacting with the fixed contact portion 58, initially positioned generally at a center on the movable contact portion 52, is gradually displaced in a direction shown by an arrow A, during a transition from the initial contact state of the movable contact portion 52 until the fully attracted state of the armature 28. This characteristic structure for displacing the contact point P on the movable contact portion 52 effects the improvement of the life of contact by preventing a contact resistance from being increased due to the repeated contact-closing motion or make/break operation in the contact section 16.

Figure 11:
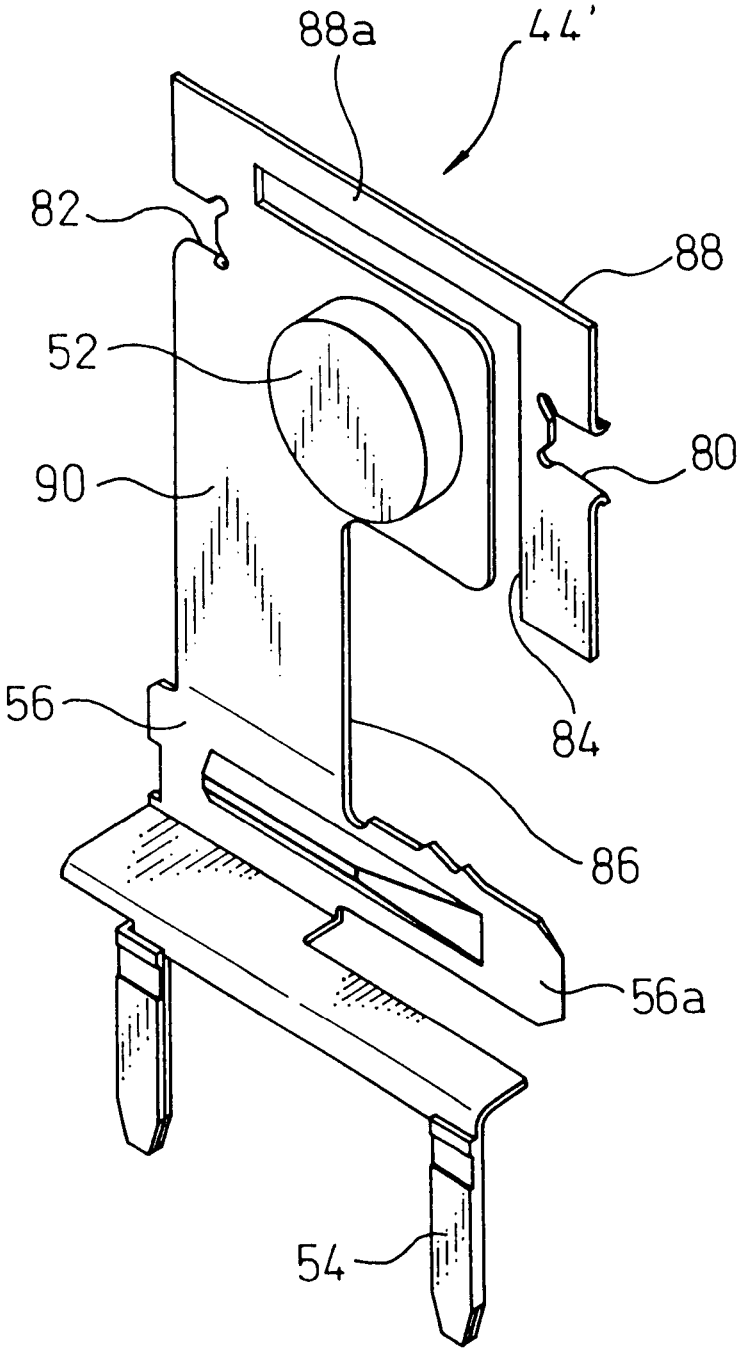
FIG. 11 is a perspective view showing a modification of a movable contact member.
Figure 12:
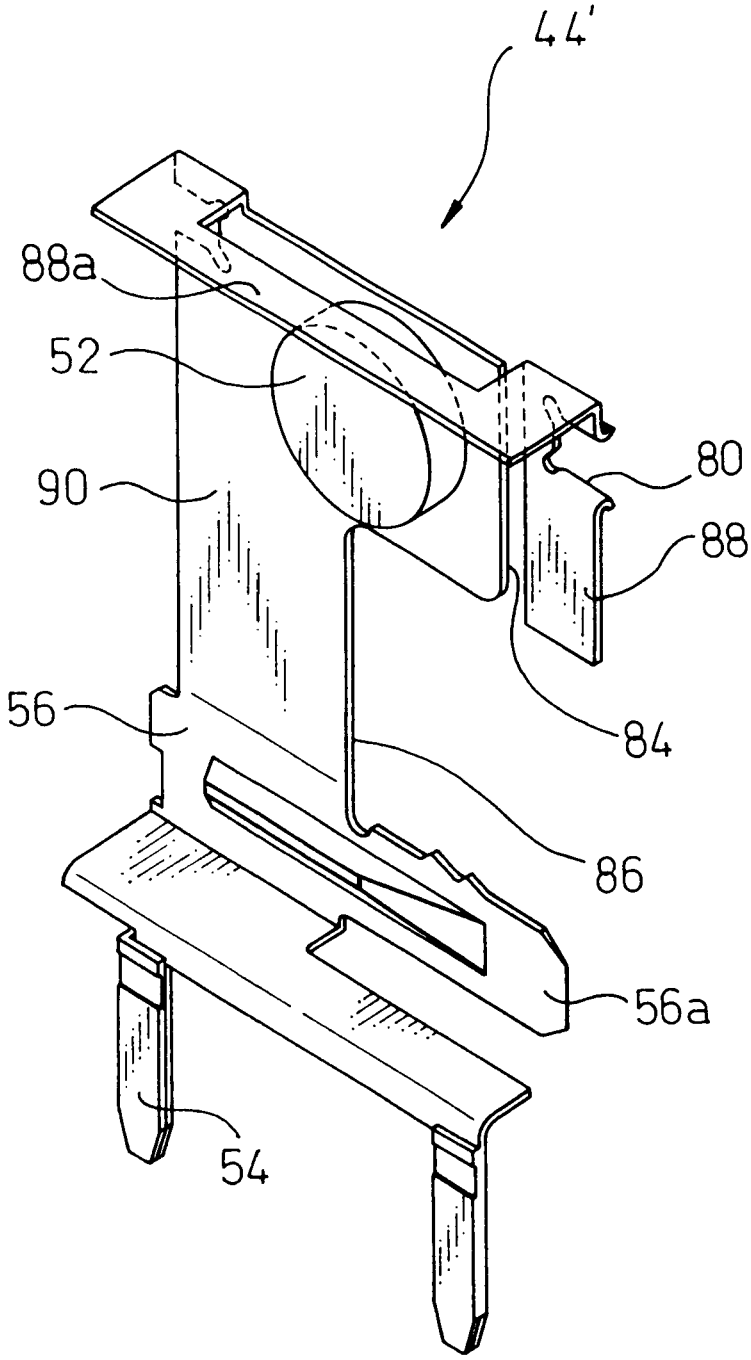
FIG. 12 is a perspective view showing another modification of a movable contact member.

The contact-point displacing structure described above may also be established in, e.g., a movable contact member 44' including the elastic arm 88, of which the proximal-end length 88*a* is located above the movable contact portion 52 and away from the peripheral edge 86, as shown in FIG. 11. In the movable contact member 44', it is possible to decrease the vertical length of the major portion 90 extending between the movable contact portion 52 and the fitting portion 56 in comparison with the movable contact member 44. Therefore, in this structure, provided that the elastic arm 88 is permanently bent near the first and second loading portions 80, 82 into such a shape that the proximal-end length 88*a* is horizontally oriented, as shown in FIG. 12, it is possible to reduce the height of the movable contact member 44' in itself, and thus to facilitate the significant height reduction of the electromagnetic relay 10.

In the above arrangement, the movable contact member 44 (44') may tend to generate such a spring force or stress as to relatively rapidly rise just before the armature 28 is fully attracted to be abutted onto the core head 34*b* of the electromagnet 26, mainly due to the increase of a distortion load in the major portion 90. The electromagnetic relay 10 is usually designed so as to prevent such spring force generated in the movable contact member 44 from exceeding the magnetic attraction force varied as a function of the travel of the armature 28. However, it may be predicted that a frictional resistance against the displacement of the contact point P is further enhanced, if the surfaces of the contact portions 46, 52, 58 are roughened due to the repeated contact-closing motion or make/break operation in the contact section 16, and that the spring force thereby exceeds the magnetic attraction force just before the armature 28 is fully attracted. In this case, it may be difficult for the armature 28 to be fully attracted, so that the electromagnetic relay 10 may operate incompletely and unstably, which may result in the significant lack of the displacement of the contact point P and thus in the relatively easy welding of the mutually contacted contact portions 46, 52, 58.

Figure 13:
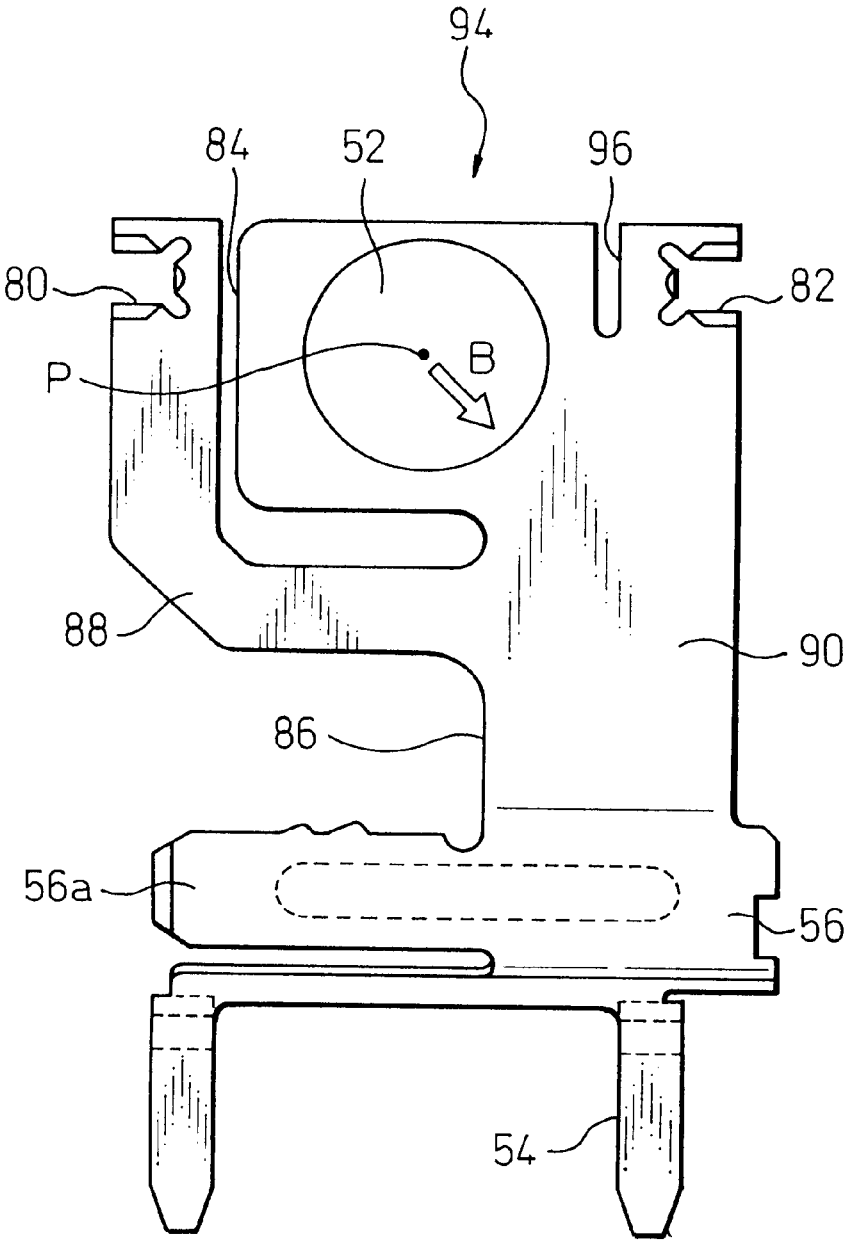
FIG. 13 is a front view showing a movable contact member incorporated in an electromagnetic relay according to another embodiment of the present invention.

FIG. 13 shows a movable contact member 94, according to a further embodiment of the present invention, including a characteristic configuration for solving the above possible inconveniences. The movable contact member 94 is additionally provided with an auxiliary slit 96 for facilitating a shifting motion of the movable contact portion 52 relative to the second loading portion 82. In this respect, the movable contact member 94 has a structure substantially identical to the movable contact member 44 except for the additional provision of the auxiliary slit 96, so that the corresponding components are denoted by the same reference numerals and the descriptions thereof are not repeated. Also, the operation of the electromagnetic relay 10 incorporating the movable contact member 94 in the contact section 16, instead of the movable contact member 44, will be described below.

The auxiliary slit 96 of the movable contact member 94 extends linearly downward from the top edge of the movable contact member 94 and asymmetrically to the main slit 84 about the movable contact portion 52, in the area between the movable contact portion 52 and the second loading portion 82. The auxiliary slit 96 serves to substantially divide the movable contact portion 52 from the second loading portion 82 so as to allow them to be independently moved relative to each other to some extent. Consequently, during a period when the movable contact member 94 moves to close the make contact, i.e., to come into contact with the opposed second fixed contact member 42, the movable contact member 94 presents such an elastic deformation mode that an area extending between the bottom ends of the main and auxiliary slits 84, 96 is elastically bent in addition to the elastic bending of the elastic arm 88 and the elastic distortion of the major portion 90, from an instant when the movable contact portion 52 contacts the fixed contact portion 58 until an instant when the armature 28 is fully magnetically attracted.

As a result, a contact point P contacting with the fixed contact portion 58, initially positioned at a generally center on the movable contact portion 52, is gradually displaced in a direction shown by an arrow B, different from the direction A shown in FIG. 10, during a transition from the initial contact state of the movable contact portion 52 until the fully attracted state of the armature 28. In this regard, the auxiliary slit 96 acts to decrease the distortion caused mainly in the major portion 90 just before the armature 28 is fully attracted, in comparison with the movable contact member 44 of FIG. 10, so that the distortion load is effectively relieved. Accordingly, the increasing rate of the spring force in the movable contact member 94 is made gently in comparison with the movable contact member 44.

The movable contact member 94 having the above structure makes it possible to improve a margin for the magnetic attraction force exceeding the spring force generated in the movable contact member 94 just before the armature 28 is fully attracted, in comparison with the movable contact member 44 having no auxiliary slit 96. Therefore, even when a frictional resistance against the displacement of the contact point P is enhanced as the surfaces of the contact portions 46, 52, 58 are roughened due to the repeated make/break operation, it is possible to effectively prevent the spring force caused in the movable contact member 94 from exceeding the magnetic attraction force just before the armature 28 is fully attracted. Accordingly, the electromagnetic relay 10 incorporating the movable contact member 94 in the contact section 16 is capable of preventing the welding of contact portions and thus performing a stable operation for a long period.

Figure 14:
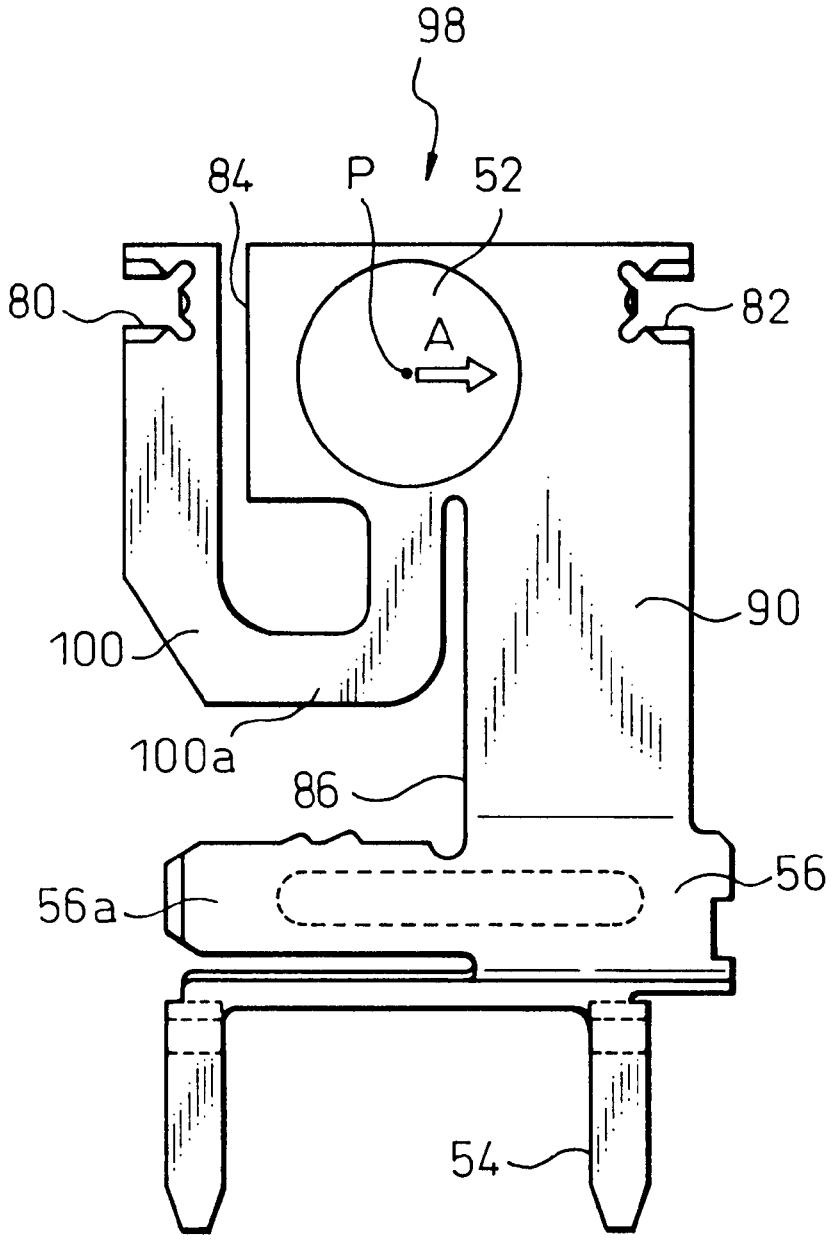
FIG. 14 is a front view showing a movable contact member incorporated in an electromagnetic relay according to a further embodiment of the present invention.

FIG. 14 shows a movable contact member 98, according to a yet further embodiment of the present invention, capable of effectively suppressing the undesirable rise of a spring force caused in the movable contact member 98 just before the armature 28 is fully attracted. The movable contact member 98 includes an elastic arm 100 provided with a proximal end length 100*a* extending in a curved manner adjacent to the generally U-shaped peripheral edge 86 defined between the movable contact portion 52 and the fitting portion 56. In this respect, the movable contact member 98 has a structure substantially identical to the movable contact member 44 except for the shape of the elastic arm 100, so that the corresponding components are denoted by the same reference numerals and the descriptions thereof are not repeated. Also, the operation of the electromagnetic relay 10 incorporating the movable contact member 98 in the contact section 16, instead of the movable contact member 44, will be described below.

The elastic arm 100 of the movable contact member 98 is integrally joined to a peripheral area just beneath the movable contact portion 52, and the proximal end length 100*a* integrally includes a certain length extending in generally parallel to the major portion 90 and another certain length extending in generally parallel to the press-fitting piece 56*a* of the fitting portion 56, while defining the peripheral edge 86 therebetween. The movable contact member 98 thus possesses a larger lengthwise dimension of the proximal end length 100*a* of the elastic arm 100, than that of the proximal end length 88*a* of the elastic arm 88 in the movable contact member 44 shown in FIG. 10.

Consequently, during a period when the movable contact member 98 moves to close the make contact, i.e., to come into contact with the opposed second fixed contact member 42, the elastic arm 100 is capable of elastically bending in the proximal end length 100*a* under a relatively lower load in comparison with the proximal end length 88*a* of the elastic arm 88, from the initial contact state of the movable contact portion 52 until the fully attracted state of the armature 28. Furthermore, the joint base of the proximal end length 100*a* of the elastic arm 100 is located just beneath the movable contact portion 52, not on the major portion 90, which makes the elastic distortion of the major portion 90 easier in comparison with the movable contact member 44. As a result, the distortion load, caused mainly in the major portion 90 just before the armature 28 is fully attracted, is effectively relieved, and therefore the increasing rate of the spring force in the movable contact member 98 is made gently, in comparison with the movable contact member 44. During this operation, a contact point P is gradually displaced in a direction shown by an arrow A, in the same way as in the movable contact member 44.

The movable contact member 98 having the above structure also makes it possible to improve a margin for the magnetic attraction force exceeding the spring force generated in the movable contact member 98 just before the armature 28 is fully attracted, in comparison with the movable contact member 44 having a relatively short elastic arm 88. Therefore, even when a frictional resistance against the displacement of the contact point P is enhanced because the surfaces of the contact portions 46, 52, 58 are roughened due to the repeated make/break operation, it is possible to effectively prevent the spring force caused in the movable contact member 98 from exceeding the magnetic attraction force just before the armature 28 is fully attracted. Accordingly, the electromagnetic relay 10 incorporating the movable contact member 98 in the contact section 16 is capable of preventing the welding of contact portions and thus performing a stable operation for a long period.

Figure 15:
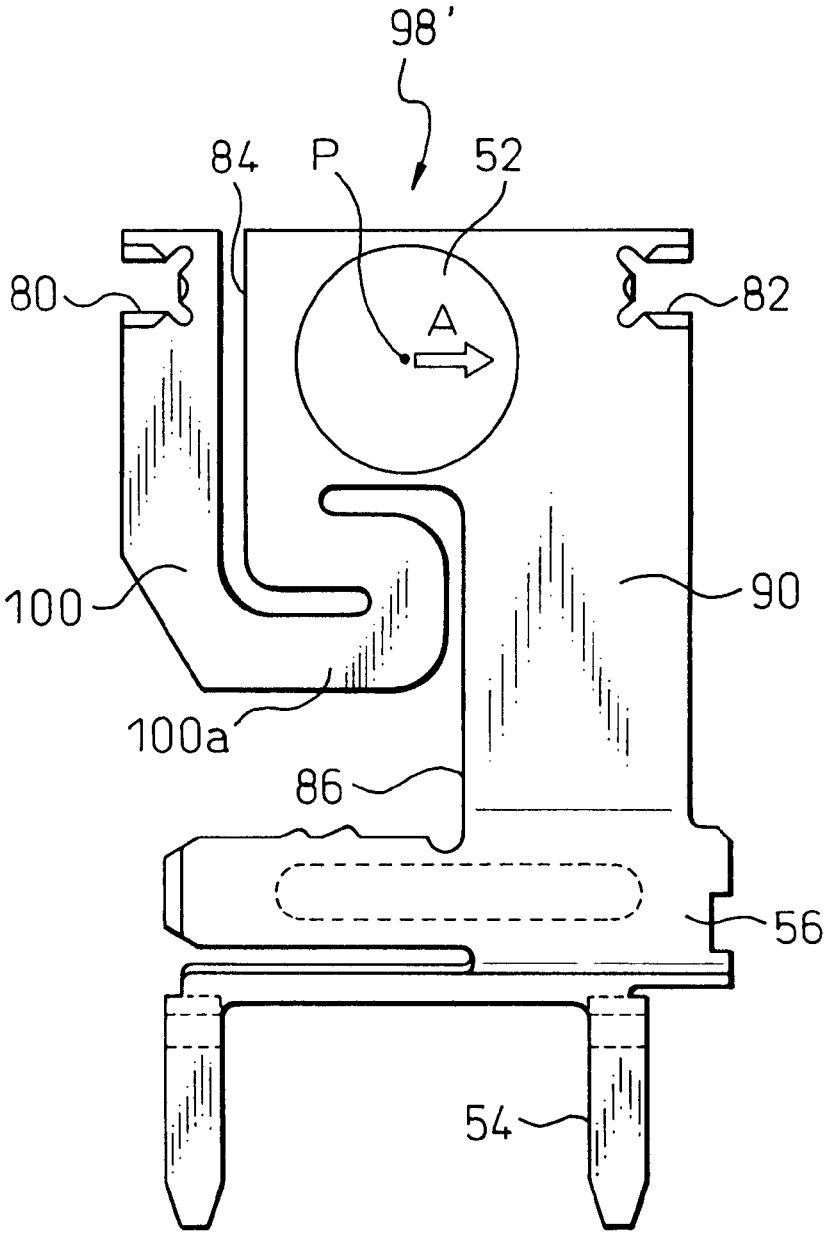
FIG. 15 is a front view showing a modification of a movable contact member.

FIG. 15 shows a modified movable contact member 98' which includes the elastic arm 100 provided with the proximal end length 100*a* extending in a meandering curved manner adjacent to the generally U-shaped peripheral edge 86 at a location under the movable contact portion 52. The elastic arm 100 having this configuration is also capable of elastically bending in the proximal end length 100*a* under a relatively lower load. Further, the joint base of the proximal end length 100*a* of the elastic arm 100 is located away from the major portion 90, which makes the elastic distortion of the major portion 90 easier. As a result, it is possible to reduce the increasing rate of the spring force caused in the movable contact member 98' just before the armature 28 is fully attracted.

The proximal end length 100*a* of the elastic arm 100 may have various shapes and dimensions other than those of the illustrated embodiments. Also, the configuration of the elastic arm 88 in the movable contact member 44', shown in FIGS. 11 and 12, is capable of effecting a function similar to the elastic arm 100, due to the extended proximal end length 88*a*. In any of the configurations described above, although the joint base of the proximal end length 88*a*, 100*a* of the elastic arm 88, 100 tends to be subjected to a local twisting stress during the closing motion for the make contact, such a twisting stress may be relieved as the distance between the joint base and the major portion 90 is increased, and thus the joint base may be hard to damage. Moreover, any of the movable contact members 44', 98, 98' may additionally be provided with the auxiliary slit 96 described in relation to the movable contact member 94, which effectively reduces the increasing rate of the spring force.

Figure 16:
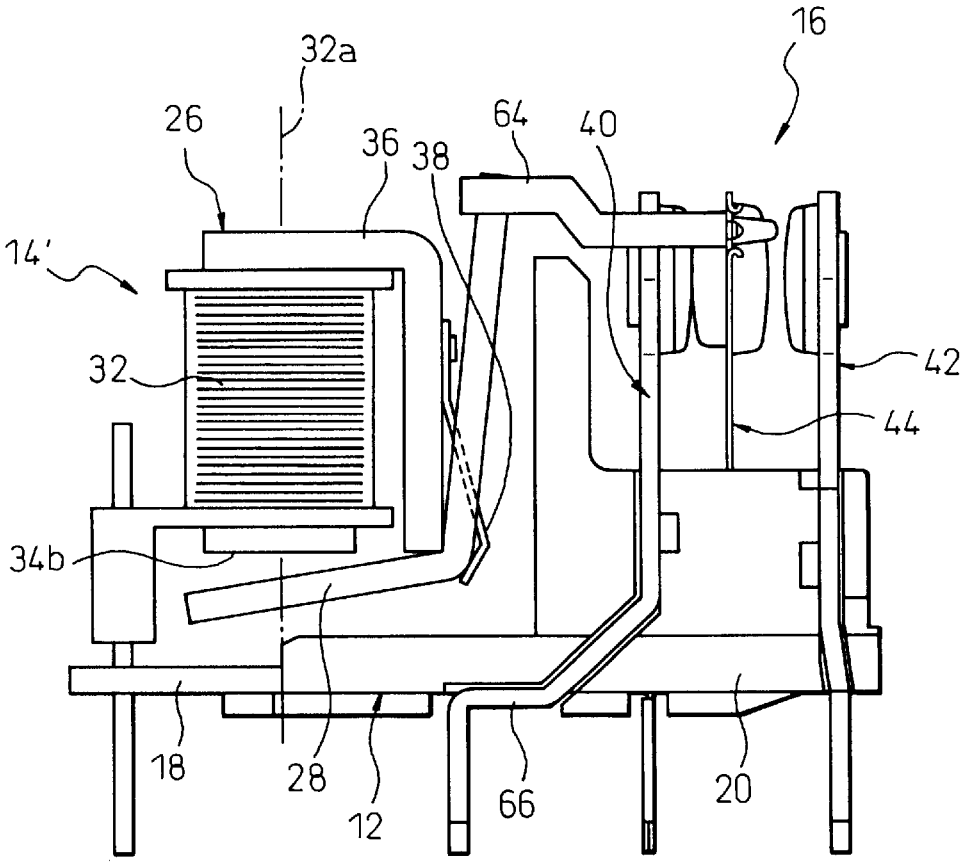
FIG. 16 is a schematic front view showing a modification of an electromagnetic relay.

The electromagnetic relay according to the present invention may adopt various forms other than the illustrated embodiments. For example, as shown in FIG. 16, the first fixed contact member 40 including the extending portion 66 may be applied to an electromagnetic relay incorporating therein an electromagnet assembly 14' having a structure different from the electromagnet assembly 14. The electromagnet assembly 14' includes the electromagnet 26 arranged above the first portion 18 of the base 12, the coil center axis 32*a* of the electromagnet 26 being oriented vertically. FIG. 16 shows various components, corresponding to those in the electromagnetic relay 10 and denoted by common reference numerals. It will be appreciated by a person skilled in the art that this electromagnetic relay may possess characteristic effects substantially identical to those in the electromagnetic relay 10 shown in FIG. 3.

The movable contact member 44 including the elastic arm 88 as well as the movable contact member 94, 98 including the auxiliary slit 96 or the extended elastic arm 100 may also be applied to the electromagnetic relay shown in FIG. 16, or to the other various conventional electromagnetic relays. In this respect, the contact-point displacing structure provided for the make contact in the illustrated embodiments may also be provided for the break contact, if necessary.

While the invention has been particularly shown and described with reference to preferred embodiments thereof, it will be understood by those skilled in the art that various changes and modifications may be made without departing from the spirit and scope of the following claims.

What is claimed is:

1. An electromagnetic relay comprising:

a base including a receptacle an electromagnet assembly incorporated in said base; and a contact section incorporated in said base to be actuated by said electromagnet assembly;

said contact section including a fixed contact member located away from said electromagnet assembly at at least a predetermined insulating distance and a movable contact member located oppositely to said fixed contact member at a position further away from said electromagnet assembly than said fixed contact member;

said fixed contact member being provided with a fixed contact portion, a first terminal portion, a fitting portion arranged between said fixed contact portion and said first terminal portion, said fitting portion being fitted and inserted in a lateral direction into said receptacle of said base, and an extending portion attached to and arranged between said fitting portion and said first terminal portion, said extending portion extending to be exposed outside from said receptacle;

said movable contact member being provided with a movable contact portion capable of contacting with said fixed contact portion of said fixed contact member and a second terminal portion spaced from said first terminal portion of said fixed contact member;

said extending portion of said fixed contact member being shaped and dimensioned to ensure at least said insulating distance and to maintain a predetermined terminal pitch between said first terminal portion of said fixed contract member and said second terminal portion of said movable contact member.

2. An electromagnetic relay as set forth in claim 1, wherein said fitting portion of said fixed contact member extends in an angled shape in said receptacle of said base while keeping at least said insulating distance, and cooperates with said extending portion to maintain said terminal pitch.

3. An electromagnetic relay as set forth in claim 1, wherein said insulating distance is 2 mm or more in a straight line.

4. An electromagnetic relay as set forth in claim 1, wherein said extending portion of said fixed contact member is covered by an adhesive.

5. An electromagnetic relay as set forth in claim 1, wherein said electromagnet assembly includes an electromagnet with a coil; and wherein said fixed contact member and said movable contact member are arranged side-by-side in a row extending along a coil center axis of said electromagnet, and said extending portion of said fixed contact member extends in a direction generally parallel to said coil center axis.

6. An electromagnetic relay as set forth in claim 5, wherein said electromagnet assembly further includes an armature driven by said electromagnet and a pair of coil terminal members connected respectively to opposite wire ends of said coil of said electromagnet, said pair of coil terminal members being arranged in a mutually spaced relationship in a direction generally orthogonal to said coil center axis; wherein each of said coil terminal members is provided with an entwining portion to which a wire end of said coil is securely entwined, a terminal portion projecting outward from said base and a bent portion arranged between said entwining portion and said terminal portion; and wherein said pair of coil terminal members define a larger space between entwining portions of said coil terminal members than a space between terminal portions of said coil terminal members, said armature being disposed in said larger space between said entwining portions.

7. An electromagnetic relay as set forth in claim 6, wherein each of said coil terminal members has a generally circular or regular-polygonal cross-sectional shape.

8. An electromagnetic relay as set forth in claim 6, wherein said electromagnet includes a bobbin for carrying said coil and said pair of coil terminal members, said bobbin being provided with a recess arranged adjacent to each of said coil terminal members for receiving a conductive wire of said coil.

9. An electromagnetic relay as set forth in claim 1, wherein said base includes a second receptacle for receiving said movable contact member; and wherein said movable contact member is further provided with a fitting portion arranged between said movable contact portion and said second terminal portion to be fitted and inserted in a lateral direction into said second receptacle of said base, first and second loading portions dispersedly arranged around said movable contact portion to be subjected to a driving force applied from said electromagnet assembly, and a slit formed between said movable contact portion and said first loading portion to facilitate a shifting motion of said movable contact portion relative to said first loading portion.

10. An electromagnetic relay as set forth in claim 9, wherein said movable contact portion is spaced from said fitting portion in said movable contact member to define a generally U-shaped peripheral edge laterally opening to a side of said first loading portion.

11. An electromagnetic relay as set forth in claim 9, wherein said movable contact member is further provided with an auxiliary slit formed between said movable contact portion and said second loading portion to facilitate a shifting motion of said movable contact portion relative to said second loading portion.

12. An electromagnetic relay as set forth in claim 11, wherein said auxiliary slit is shaped asymmetrically to said slit about said movable contact portion.

13. An electromagnet relay comprising:

a base including a receptacle an electromagnet assembly incorporated in said base; and a contact section incorporated in said base to be actuated by said electromagnet assembly;

said contact section including a fixed contact member located away from said electromagnet assembly at at least a predetermined insulating distance and a movable contact member located oppositely to said fixed contact member at a position further away from said electromagnet assembly than said fixed contact member;

said fixed contact member being provided with a fixed contact portion, a first terminal portion, a fitting portion arranged between said fixed contact portion and said first terminal portion, said fitting portion being fitted and inserted in a lateral direction into said receptacle of said base, and an extending portion attached to and arranged between said fitting portion and said first terminal portion, said extending portion extending to be exposed outside from said receptacle;

said movable contact member being provided with a movable contact portion capable of contacting with said fixed contact portion of said fixed contact member and a second terminal portion spaced from said first terminal portion of said fixed contact member;

said extending portion of said fixed contact member being shaped and dimensioned to ensure at least said insulating distance and to maintain a predetermined terminal pitch between said first terminal portion of said fixed contract member and said second terminal portion of said movable contact member, wherein said extending portion of said fixed contact member is covered by an adhesive.

14. An electromagnetic relay as set forth in claim 13, wherein said electromagnet assembly includes an electromagnet with a coil; and wherein said fixed contact member and said movable contact member are arranged side-by-side in a row extending along a coil center axis of said electromagnet, and said extending portion of said fixed contact member extends in a direction generally parallel to said coil center axis.

15. An electromagnetic relay as set forth in claim 14, wherein said electromagnet assembly further includes an armature driven by said electromagnet and a pair of coil terminal members connected respectively to opposite wire ends of said coil of said electromagnet, said pair of coil terminal members being arranged in a mutually spaced relationship in a direction generally orthogonal to said coil center axis; wherein each of said coil terminal members is provided with an entwining portion to which a wire end of said coil is securely entwined, a terminal portion projecting outward from said base and a bent portion arranged between said entwining portion and said terminal portion; and wherein said pair of coil terminal members defined a larger space between entwining portions of said coil terminal members than a space between terminal portions of said coil terminal members, said armature being disposed in said larger space between said entwining portions.

16. An electromagnetic relay as set forth in claim 15, wherein each of said coil terminal members has a generally circular or regular-polygonal cross-sectional shape.

17. An electromagnetic relay as set forth in claim 15, wherein said electromagnet includes a bobbin for carrying said coil and said pair of coil terminal members, said bobbin being provided with a recess arranged adjacent to each of said coil terminal members for receiving a conductive wire of said coil.

18. An electromagnetic relay comprising:

a base including a receptacle an electromagnet assembly incorporated in said base; and a contact section incorporated in said base to be actuated by said electromagnet assembly;

said contact section including a fixed contact member located away from said electromagnet assembly at at least a predetermined insulating distance and a movable contact member located oppositely to said fixed contact member at a position further away from said electromagnet assembly than said fixed contact member;

said fixed contact member being provided with a fixed contact portion, a first terminal portion, a fitting portion arranged between said fixed contact portion and said first terminal portion, said fitting portion being fitted and inserted in a lateral direction into said receptacle of said base, and an extending portion attached to and arranged between said fitting portion and said first terminal portion, said extending portion extending to be exposed outside from said receptacle;

said movable contact member being provided with a movable contact portion capable of contacting with said fixed contact portion of said fixed contact member and a second terminal portion spaced from said first terminal portion of said fixed contact member;

said extending portion of said fixed contact member being shaped and dimensioned to ensure at least said insulating distance and to maintain a predetermined terminal pitch between said first terminal portion of said fixed contract member and said second terminal portion of said movable contact member, wherein said base includes a second receptacle for receiving said movable contact member; and wherein said movable contact member is further provided with a fitting portion arranged between said movable contact portion and said second terminal portion to be fitted and inserted in a lateral direction into said second receptacle of said base, first and second loading portion dispersedly arranged around said movable contact portion to be subjected to a driving force applied from said electromagnet assembly, and a slit formed between said movable contact portion and said first loading portion to facilitate a shifting motion of said movable portion relative to said first loading portion, and wherein said movable contact portion is spaced from said fitting portion in said movable contact member to define a generally U-shaped peripheral edge laterally opening to a side of said first loading portion.

19. An electromagnetic relay as set forth in claim 18, wherein said movable contact member is further provided with an auxiliary slit formed between said movable contact portion and said second loading portion to facilitate a shifting motion of said movable contact portion relative to said second loading portion.

20. An electromagnetic relay as set forth in claim 19, wherein said auxiliary slit is shaped asymmetrically to said slit about said movable contact portion.

21. An electromagnetic relay comprising:

a base including a receptacle;

an electromagnetic assembly incorporated in said base; and a contact section incorporated in said base to be actuated by said electromagnet assembly;

said contact section including a fixed contact member and a movable contact member;

said fixed contact member being provided with a fixed contact portion and a first terminal portion;

said movable contact member being provided with a movable contact portion capable of contacting with said fixed contact portion of said fixed contact member, a second terminal portion spaced from said first terminal portion of said fixed contact member, a fitting portion arranged between said movable contact portion and said second terminal portion to be fitted and inserted in a lateral direction into said receptacle of said base, first and second loading portions dispersedly arranged around said movable contact portion to be subjected to a driving force from said electromagnet assembly, and a slit formed between said movable contact portion and said first loading portion to facilitate a shifting motion of said movable contact portion relative to said first loading portion, wherein said movable contact portion is spaced from said fitting portion in said movable contact member to define a generally U-shaped peripheral edge laterally opening to a side of said first loading portion.

22. An electromagnetic relay as set forth in claim 21, wherein said movable contact member is further provided with an auxiliary slit formed between said movable contact portion and said second loading portion to facilitate a shifting motion of said movable contact portion relative to said second loading portion.

23. An electromagnetic relay as set forth in claim 22, wherein said auxiliary slit is shaped asymmetrically to said slit about said movable contact portion.

24. An electromagnetic relay comprising:

a base including a receptacle;

an electromagnetic assembly incorporated in said base; and a contact section incorporated in said base to be actuated by said electromagnet assembly;

said contact section including a fixed contact member and a movable contact member;

said fixed contact member being provided with a fixed contact portion and a first terminal portion;

said movable contact member being provided with a movable contact portion capable of contacting with said fixed contact portion of said fixed contact member, a second terminal portion spaced from said first terminal portion of said fixed contact member, a fitting portion arranged between said movable contact portion and said second terminal portion to be fitted and inserted in a lateral direction into said receptacle said base, first and second loading portions dispersedly arranged around said movable contact portion to be subjected to a driving force from said electromagnet assembly, and a slit formed between said movable contact portion and said first loading portion to facilitate a shifting motion of said movable contact portion relative to said first loading portion, wherein said movable contact portion is spaced from said fitting portion in said movable contact member to define a generally U-shaped peripheral edge laterally opening to a side of said first loading portion, and wherein said slit of said movable contact member defines an elastic arm including said first loading portion and disposed around said movable contact portion, said elastic arm being provided with a proximal end length extending adjacent to said generally U-shaped peripheral edge.

25. An electromagnetic relay as set forth in claim 24, wherein said proximal end length of said elastic arm extends in a curved manner adjacent to said generally U-Shaped peripheral edge.

* * * * *